US006729131B2

(12) United States Patent
Kocsisek

(10) Patent No.: US 6,729,131 B2
(45) Date of Patent: May 4, 2004

(54) STIRLING ENGINE

(76) Inventor: Karl Kocsisek, Gartengasse 11, Haslau/Donau (AT), 2402

( * ) Notice: Subject to any disclaimer, the term of this patent is extended or adjusted under 35 U.S.C. 154(b) by 0 days.

(21) Appl. No.: 10/276,958

(22) PCT Filed: May 29, 2001

(86) PCT No.: PCT/AT01/00169

§ 371 (c)(1),
(2), (4) Date: Nov. 21, 2002

(87) PCT Pub. No.: WO01/92708

PCT Pub. Date: Dec. 6, 2001

(65) Prior Publication Data

US 2003/0167766 A1 Sep. 11, 2003

(30) Foreign Application Priority Data

May 29, 2000 (AT) ..... 936/2000

(51) Int. Cl.[7] ..... F01B 29/10
(52) U.S. Cl. ..... 60/517; 60/525
(58) Field of Search ..... 60/517, 518, 519, 60/525, 526

(56) References Cited

U.S. PATENT DOCUMENTS

| | | | | |
|---|---|---|---|---|
| 273,276 A | | 3/1883 | Hawkinson | |
| 926,564 A | | 6/1909 | Hollopeter | |
| 1,909,372 A | | 4/1928 | McCollum | |
| 2,822,791 A | | 7/1955 | Biermann | |
| 2,873,611 A | | 7/1955 | Bierman | |
| 2,776,573 A | | 1/1957 | Willi | |
| 3,886,744 A | | 6/1975 | Jaspers | |
| 4,346,677 A | * | 8/1982 | Nye | 123/53.1 |
| 4,387,566 A | | 6/1983 | Berchowitz | |
| 4,392,350 A | * | 7/1983 | Marks | 60/518 |
| 4,553,392 A | | 11/1985 | Chagnot et al. | |
| 4,917,066 A | | 4/1990 | Freudenstein et al. | |
| 4,970,861 A | * | 11/1990 | Randall | 60/431 |
| 5,136,987 A | | 8/1992 | Schechter et al. | |
| 5,345,765 A | * | 9/1994 | Kinnersly | 60/525 |
| 5,737,924 A | * | 4/1998 | Taguchi et al. | 62/6 |

FOREIGN PATENT DOCUMENTS

| | | |
|---|---|---|
| FR | 2 465 133 | 3/1981 |
| GB | 1 266 451 | 3/1972 |
| GB | 2 211 262 | 6/1989 |

* cited by examiner

*Primary Examiner*—Hoang Nguyen

(57) ABSTRACT

A Stirling engine (10, 50, 72) comprising at least one working piston (52) and at least one displacement piston (4), wherein for a power control by the transmission of the linear movement of a drive part (2) into the linear movement of a driven part (8), a lever (5) articulately connected to the drive part and the driven part (2, 8) is provided, which lever has an associated displaceable pivot point (7), the bearing point of the lever (5) traveling on the pivot point (7) according to a curve during movement transmission.

16 Claims, 23 Drawing Sheets

STIRLING ENGINE

CROSS REFERENCE TO RELATED APPLICATIONS

Applicant claims priority under 35 U.S.C. §119 of Austrian Application No. A 936/2000 filed May 29, 2000. Applicant also claims priority under 35 U.S.C. §365 of PCT/ATOl/00169 filed May 29, 2001. The international application under PCT article 21(2) was not published in English.

The invention relates to a Stirling engine comprising at least one working piston and at least one displacement piston.

Depending on what type of drive unit is provided for a rotary drive, there are many possible ways of controlling the power of the rotary drive. In combustion engines, the power can be controlled very well via the fuel supply, whereas, e.g., in Stirling engines a power control without a loss in efficiency has been a great problem for quite some time. For controlling the power of Stirling engines it has been known to change the clearance volumes, on the one hand, and to change the pressure of the working gas, on the other hand, wherein, however, losses in efficiency, or relatively long reduction times, respectively, occur with both types of power control.

From U.S. Pat. No. 3,886,744 A, e.g., a power control system for a Stirling engine is known in which the inlet pressure of the hot air is controlled via an annular control element which opens or closes the inlet depending on the differential pressure present; this has the disadvantage that a very complex construction is provided and that the efficiency of the Stirling engine declines as a consequence of the pressure control.

From U.S. Pat. No. 2,873,611 A, a combustion engine is known—in which the stroke of a piston can be changed with the assistance of a circular-arc-shaped lever arm, and thus the power of the driven-side crank can be adjusted. For this purpose, the lever arm has a connecting link guide in which a connecting head is slidably mounted. Since, however, in combustion engines numerous other advantageous possibilities are available for an efficient power control, such an arrangement is not suitable in combustion engines.

The invention has as its object to provide a Stirling engine of the initially defined type with which a rapid power control is possible without lowering its efficiency.

The Stirling engine according to the invention and of the initially defined type is characterized in that for a power control by means of the transmission of the linear movement of a drive part into the linear movement of a driven part, a lever articulately connected to the drive part and the driven part is provided, which lever has an associated displaceable pivot point, the bearing point of the lever traveling on the pivot point according to a curve during the movement transmission. This curve may have any shape desired—depending on the requirements of the movement transmission and on the type of the respective Stirling engine.

Since the theoretical power of a Stirling engine—considering an isothermal expansion and compression—can be expressed by $$P = (1-\tau)\frac{\pi * n}{60} V_{E,\max} * P_m \frac{\delta}{1+\sqrt{1-\delta^2}} * \sin\Theta, \text{ with}$$

P . . . power

τ. . . temperature ratio between compression space and expansion space, n . . . number of revolutions [U/min]

$V_{E,max}$ . . . maximum volume of the expansion space $V_{c,max}$ . . . maximum volume of the compression space $P_m$ . . . effective mean pressure δ. . . pressure ratio of engine and $$\Theta \ldots \tan\Theta = \frac{w\sin\varphi}{\tau + w\cos\varphi},$$

with ϕ=phase angle between working piston and displacement piston, and $$w = \frac{V_{C,\max}}{V_{E,\max}}$$

the ratio of the maximum volumes of compression and expansion, as well as $$\tau = \frac{T_C}{T_E}$$

the temperature ratio between compression volume and expansion volume, a power control can be carried out by means of the lever arrangement according to the characterizing part of claim 1 without any losses in efficiency, since preferably the maximum compression volume $V_{c,max}$ and, thus, the pressure ratios δ of the engine can be controlled very well.

By adjusting the pivot point on which the lever or its bearing point, respectively, travel during the movement transmission, thus the velocity and the acceleration of the driven part and a change in the maximum volumes of the compression space caused thereby can be obtained in a very simple way, whereby the power of the Stirling engine can be controlled.

For realizing the change of the bearing point of the lever during the movement transmission with a simple construction, it is advantageous if the lever has a connecting link defining the given curve, which connecting link slides over the pivot point, e.g. via a roller defining this pivot point, during the movement transmission.

For a well-defined power control of the Stirling engine it has proven particularly advantageous if the curve or connecting link has the shape of a circular arc; yet other curve shapes are, of course, also conceivable for certain purposes of use, e.g. two tangentially connected circular arc segments, or an elliptical shape.

To allow for a simple adjustment of the pivot point, it is advantageous if the pivot point is arranged on a pivot arm.

Shifting of the pivot point can be realized in a structurally particularly simple manner if the pivot arm is connected to an adjustment device.

To equally adjust each point of rotation of two levers—in case at least two cylinders are used, it is advantageous if the adjustment device is connected to a pivot arm via one linkage each and is symmetrically provided between at least two levers.

For a simple configuration of the adjustment device in terms of construction, it is suitable if a spindle drive is provided as the adjustment device.

If a connecting link guide is provided in which the end of the linkage arranged opposite the pivot arm is displaceably and fixably received, the position of the pivot arm can be changed in a simple and quick manner and thus, the power of the Stirling engine can be adjusted.

In a Stirling engine with a double-active working cylinder, in which the movement of the working piston occurs in a sine-shape, it is advantageous if the displacement piston is associated with the lever for a power control, whereby a dynamic stroke change as well as a discontinuous movement of the displacement piston will occur.

In a β-Stirling engine, with which in general higher mechanic efficiencies are obtained than with the remaining types of Stirling engines, the displacement piston and the working piston are located in a common cylinder, whereby, in theory, it is possible for the entire gas mass to be located in the hot space during the expansion phase and to be located in the cold space during the compression phase. For an efficiency-neutral power control it is then advantageous if the working piston is associated with the lever with a displaceable pivot point, and the displacement lever is associated with a lever with a non-displaceable pivot point.

In a double-active engine, in which the working piston and the displacement piston form one unit for the purpose of a simple construction of the Stirling engine, this unit is associated with the lever for an advantageous power control.

For a reliable movement of the displacement piston and of the working piston, respectively, it is suitable if the drive part is articulately connected to a piston rod which is linearly guided in a straight-line guide and connected to the displacement piston or to the working piston, respectively.

For the required heat exchange to the working gas between the heater and cooler surfaces, respectively, it is suitable if the displacement piston on both sides and the working piston on one side thereof has a wave-shaped section capable of engaging in the neighboring heater or cooler surfaces, respectively. In this manner, substantially larger surfaces can get into contact with the working gas, as compared to plane surfaces. As regards a high strength of the displacement piston, it is suitable if the lamella-type wave-shaped sections of the displacement piston are arranged to be turned by 90° relative to each other. Also for a high strength it is advantageous if the lamella-type thin-walled wave-shaped sections of the working piston or heater head, respectively, are supported by stiffening ribs at the burner side and at the coolant side, respectively. An integration of heater-, regenerator- and cooler-surfaces directly into the working space is particularly advantageous in terms of efficiency and of minimizing the detrimental volume of a Stirling engine.

Instead of cooperating at the driven side with a conventional crankshaft, it may be advantageous in terms of the kinematics for a maximum approach to the ideal circle process, if the linear movement of the driven part is converted into a rotational movement by means of a connecting link which serves as a crank.

In the following, the invention will be described in more detail by way of preferred exemplary embodiments illustrated in the drawings to which, however, it shall not be restricted. In detail, in the drawings, FIG. 1 shows a schematic view of an arrangement for the controlled conversion of linear movements, wherein a drive part, the linear movement of which is converted via a lever whose bearing point travels on the pivot point according to a curve, is in its lower-end position;

Figure 13:
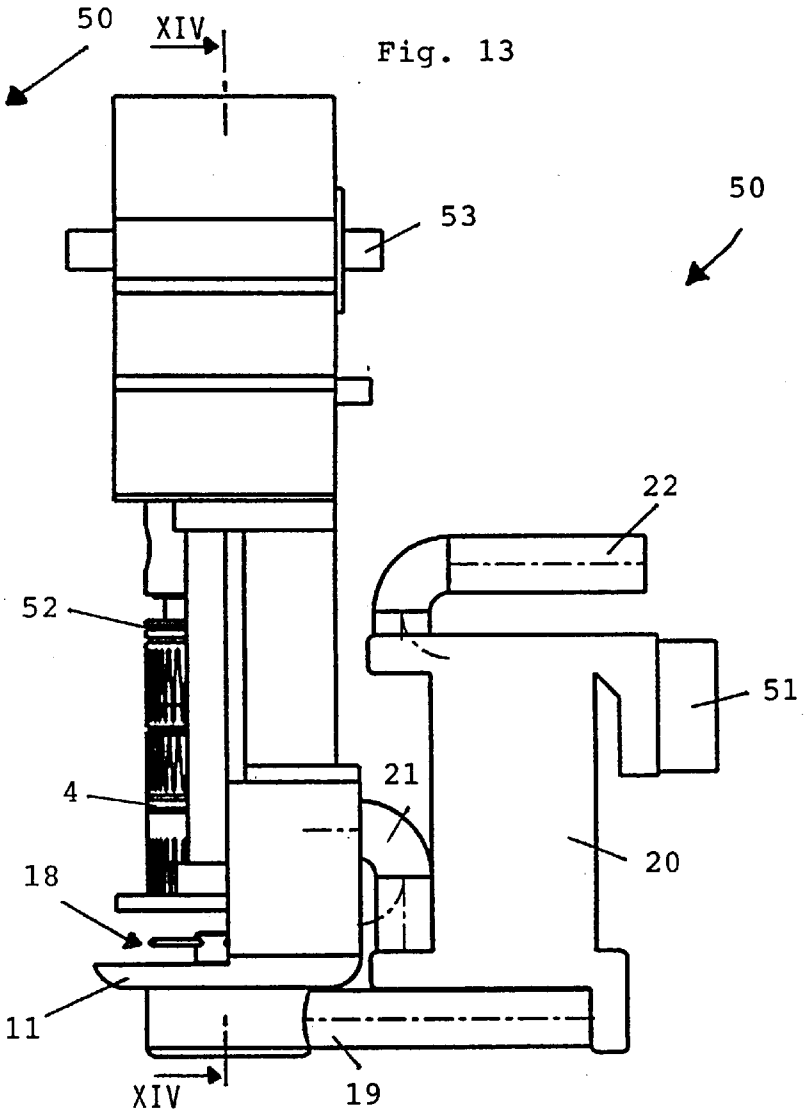
Figure 12:
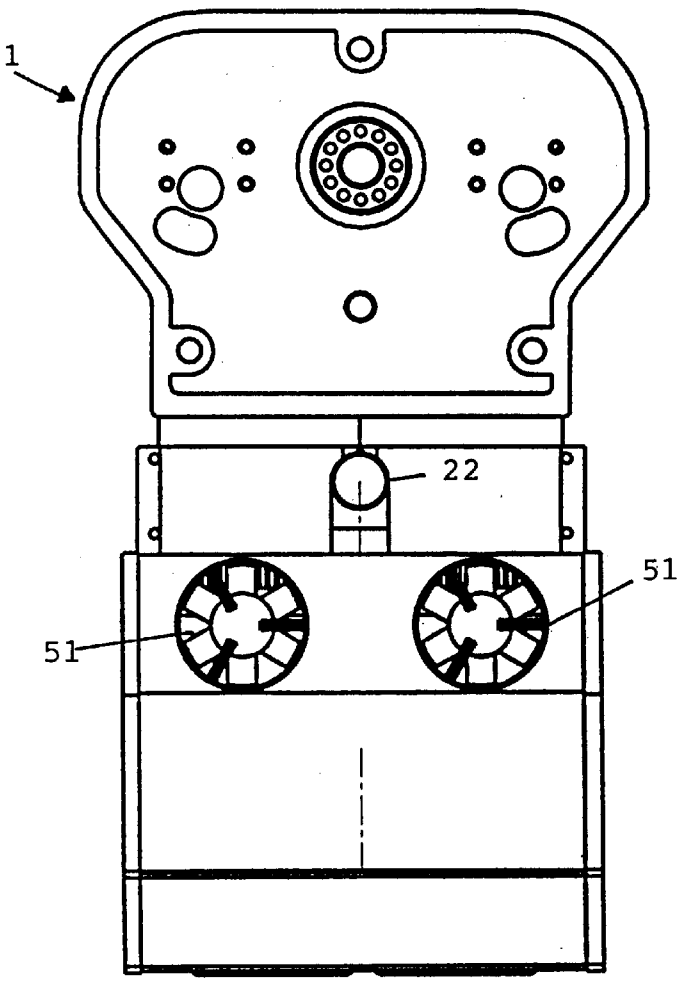
Figure 14:
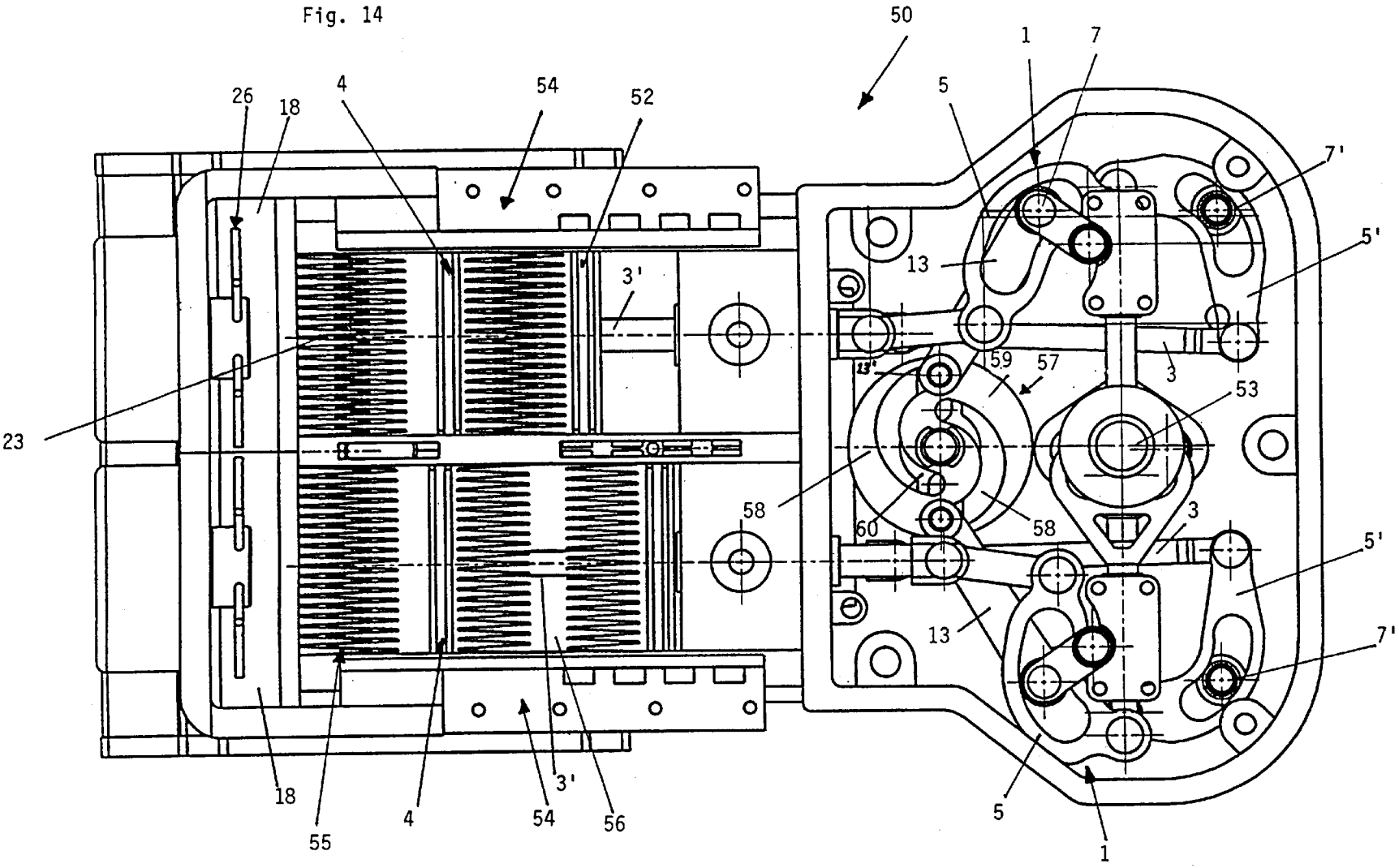
Figure 15:
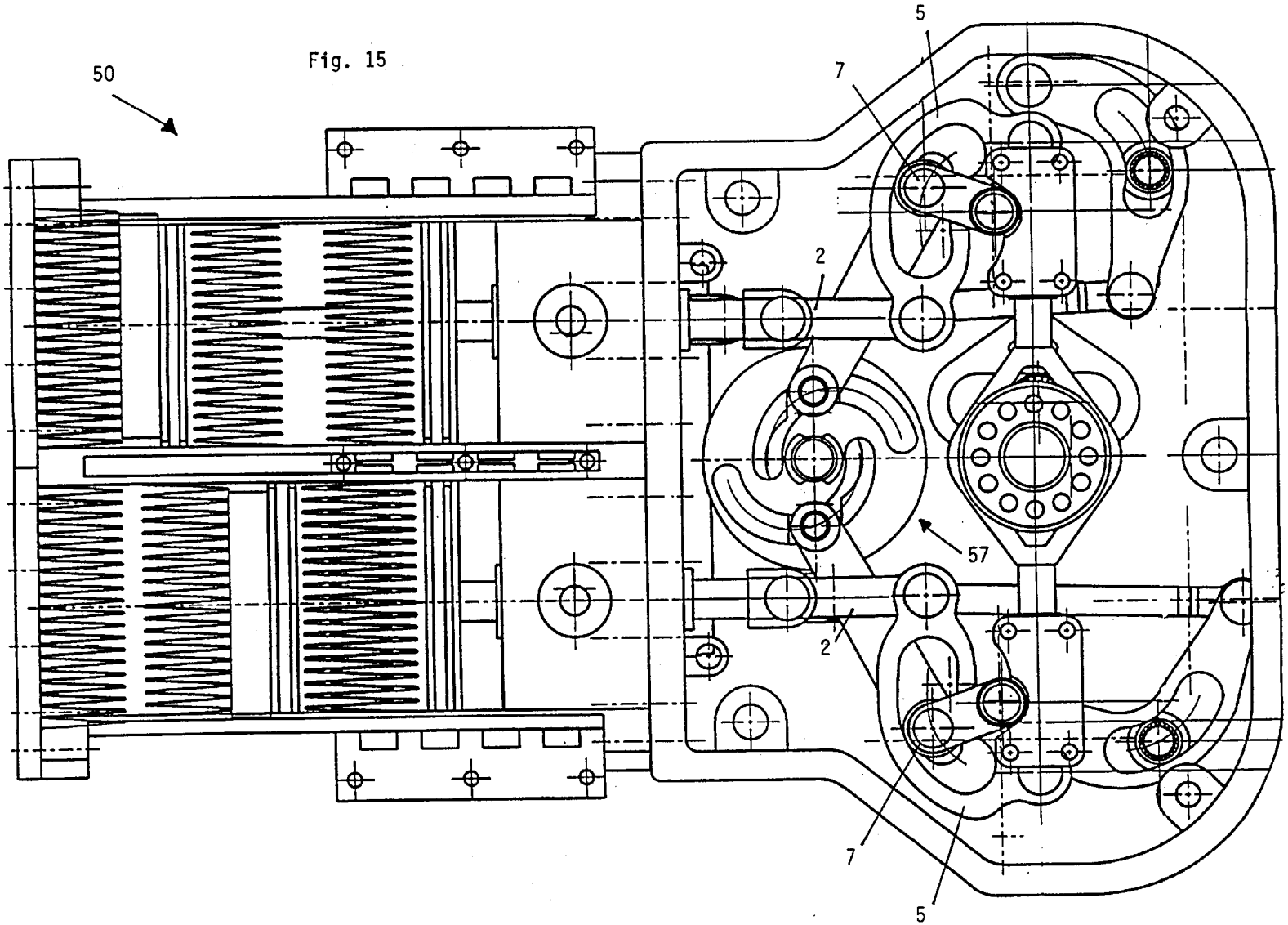
Figure 16:
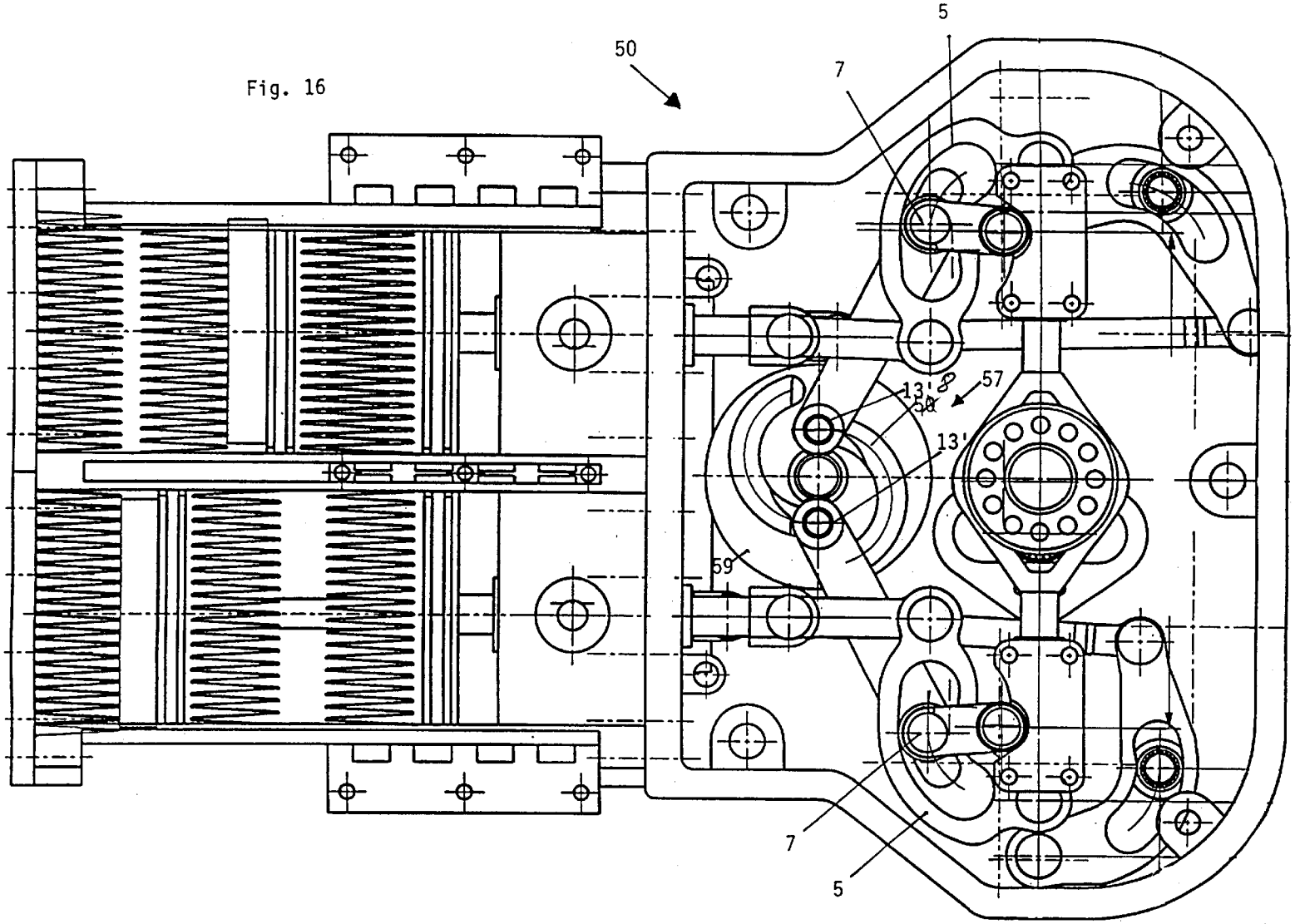
Figure 17:
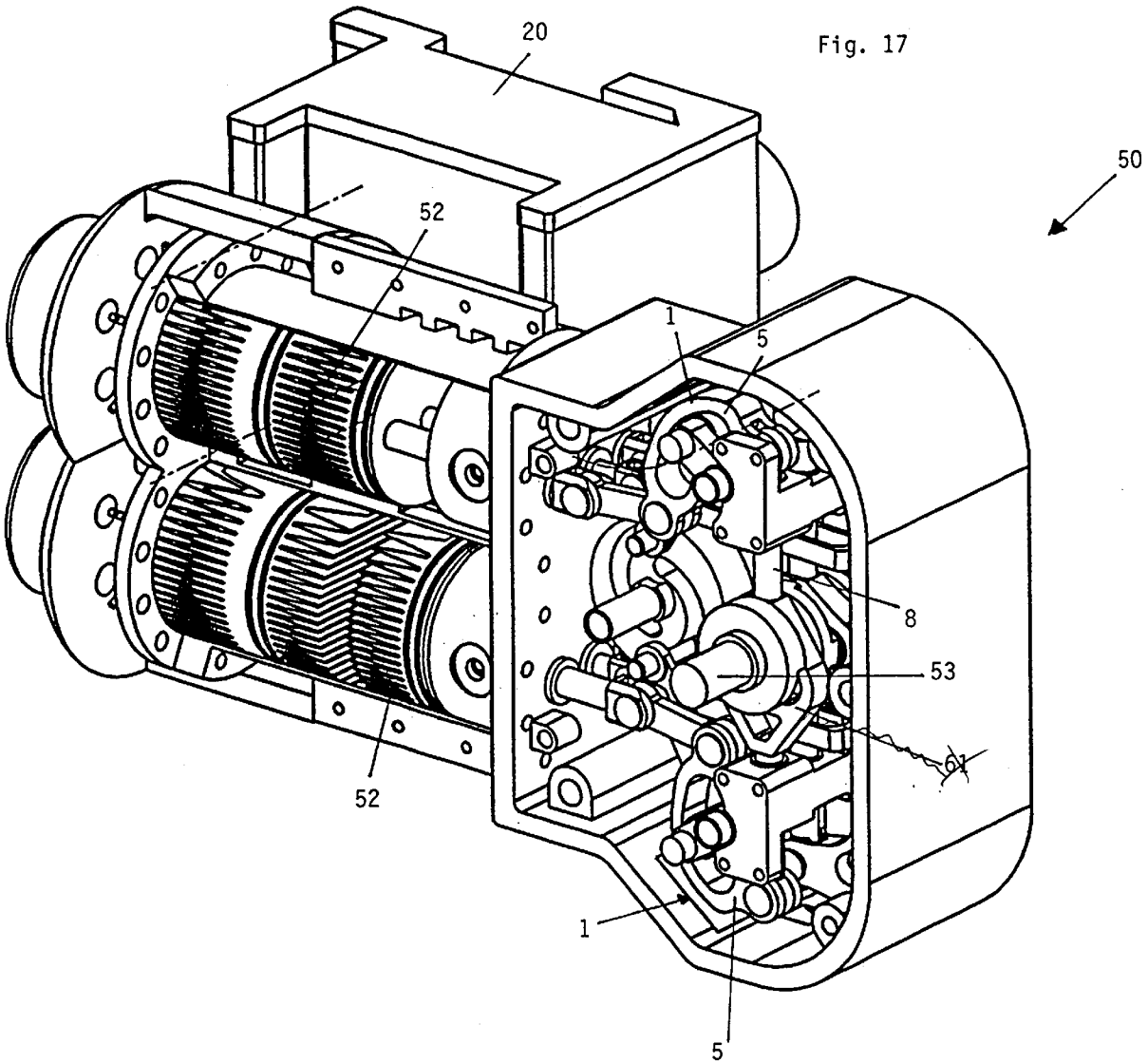
Figure 18:
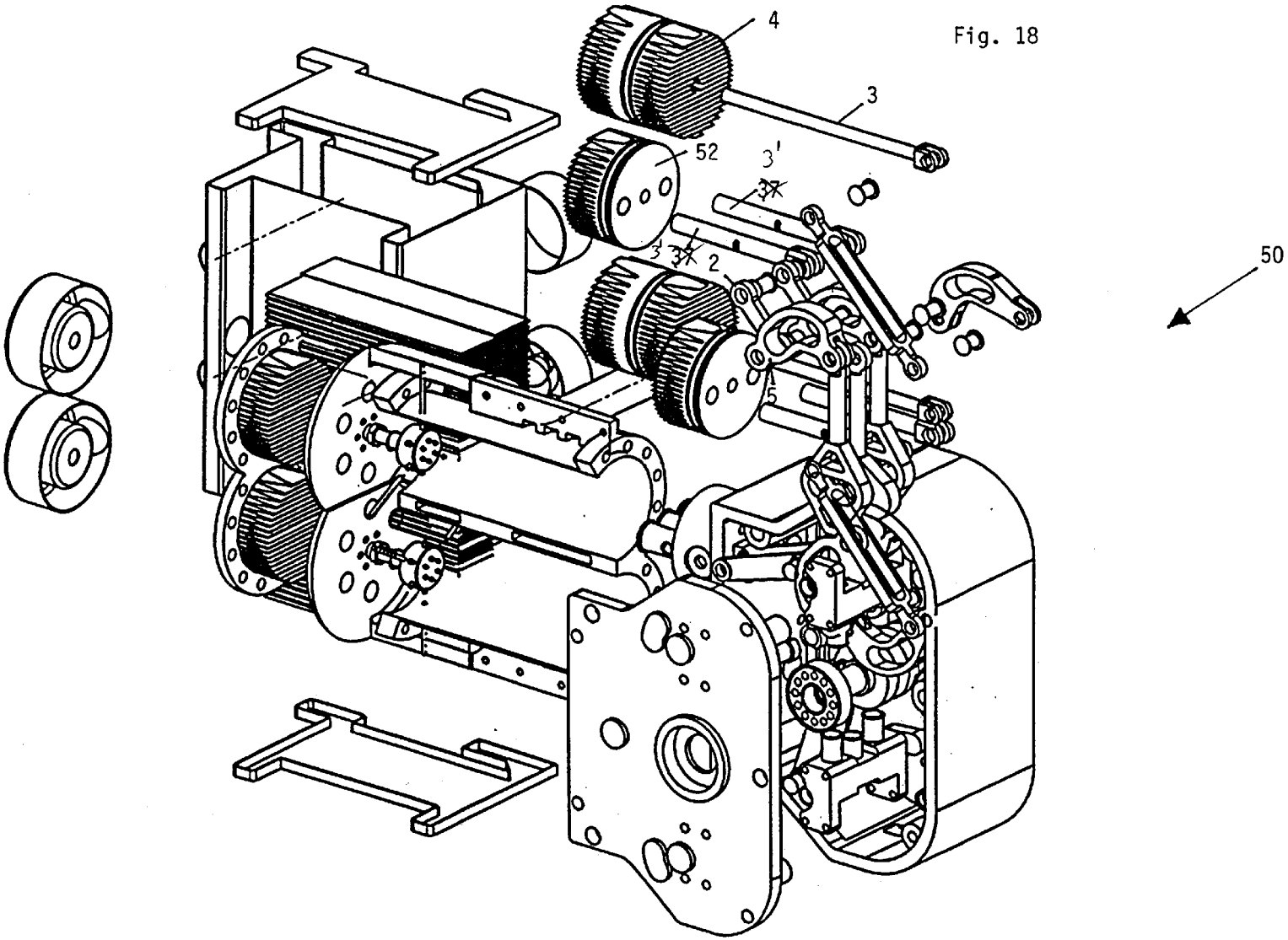
Figure 21:
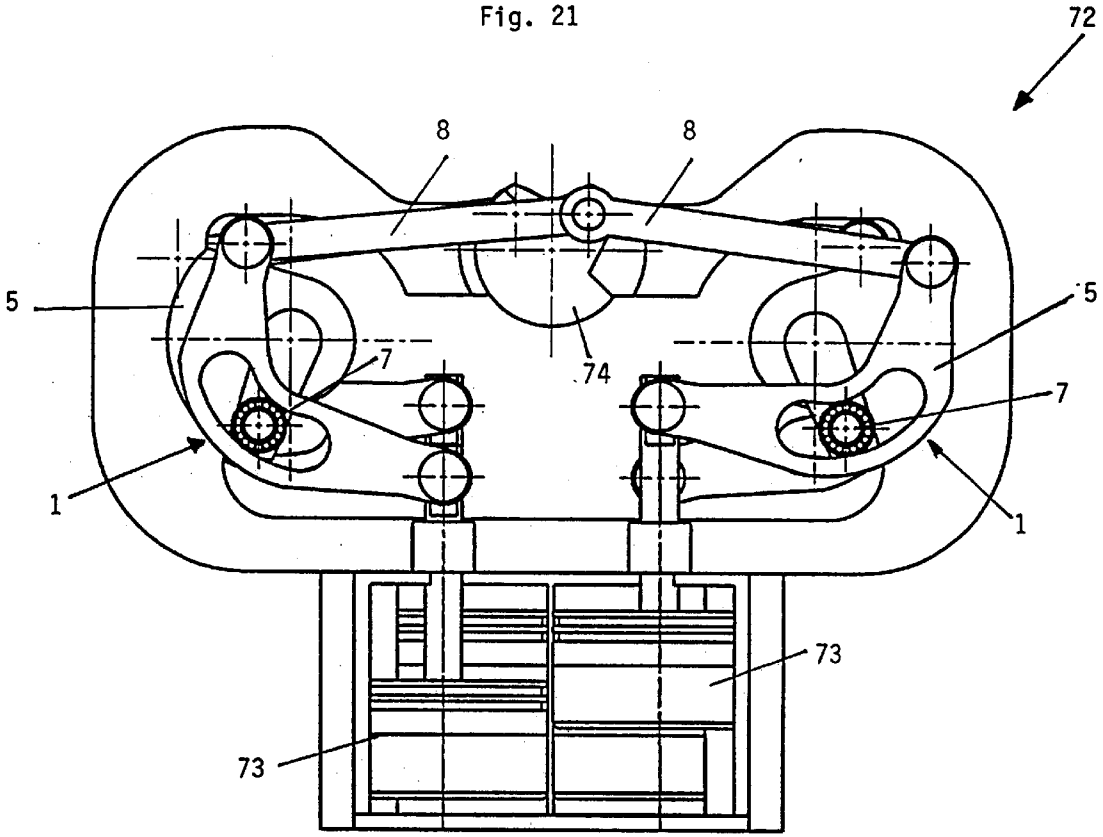
Figure 20:
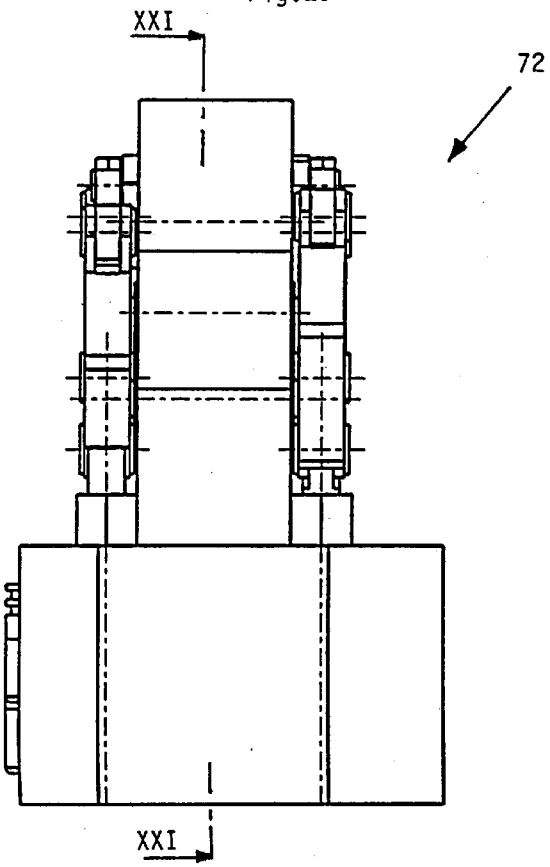

FIGS. 11*a* to 11*d* are different graphs regarding the Stirling engine illustrated in FIGS. 4 to 7, a different position of the pivot point of the lever for controlling the reciprocating movement of the drive part being shown in each case;

FIG. 12 shows a view of a β-Stirling-two-cylinder engine comprising two displacement units and one device each for controlling, over time, the stroke movement and the movement of a working piston;

FIG. 13 is a partially broken away side view of the β-engine according to FIG. 12;

FIG. 14 is a sectional representation according to line XIV—XIV of FIG. 13, with the pivot points being at their maximum power position and the working pistons reaching their maximum stroke;

FIG. 15 is a side view of the β-engine according to FIG. 14, with the pivot points being in an intermediate position;

FIG. 16 shows a view of the β-engine according to FIGS. 14 and 15, with the pivot points being in a power-minimizing position;

FIG. 17 shows a perspective view of the sectional representation according to FIGS. 14 to 16;

FIG. 18 shows an exploded view of the β-engine according to FIGS. 12 to 17;

FIGS. 19*a* to 19*d* show different graphs regarding the β-engine illustrated in FIGS. 12 to 18, each graph showing a different position of the pivot point of the lever for controlling the receiprocating movement of the drive shaft;

FIG. 20 shows a view of a double-active Stirling engine with an arrangement for the controlled conversion of linear movements; and FIG. 21 shows a sectional representation according to line XXI—XXI of FIG. 20.

Figure 1:
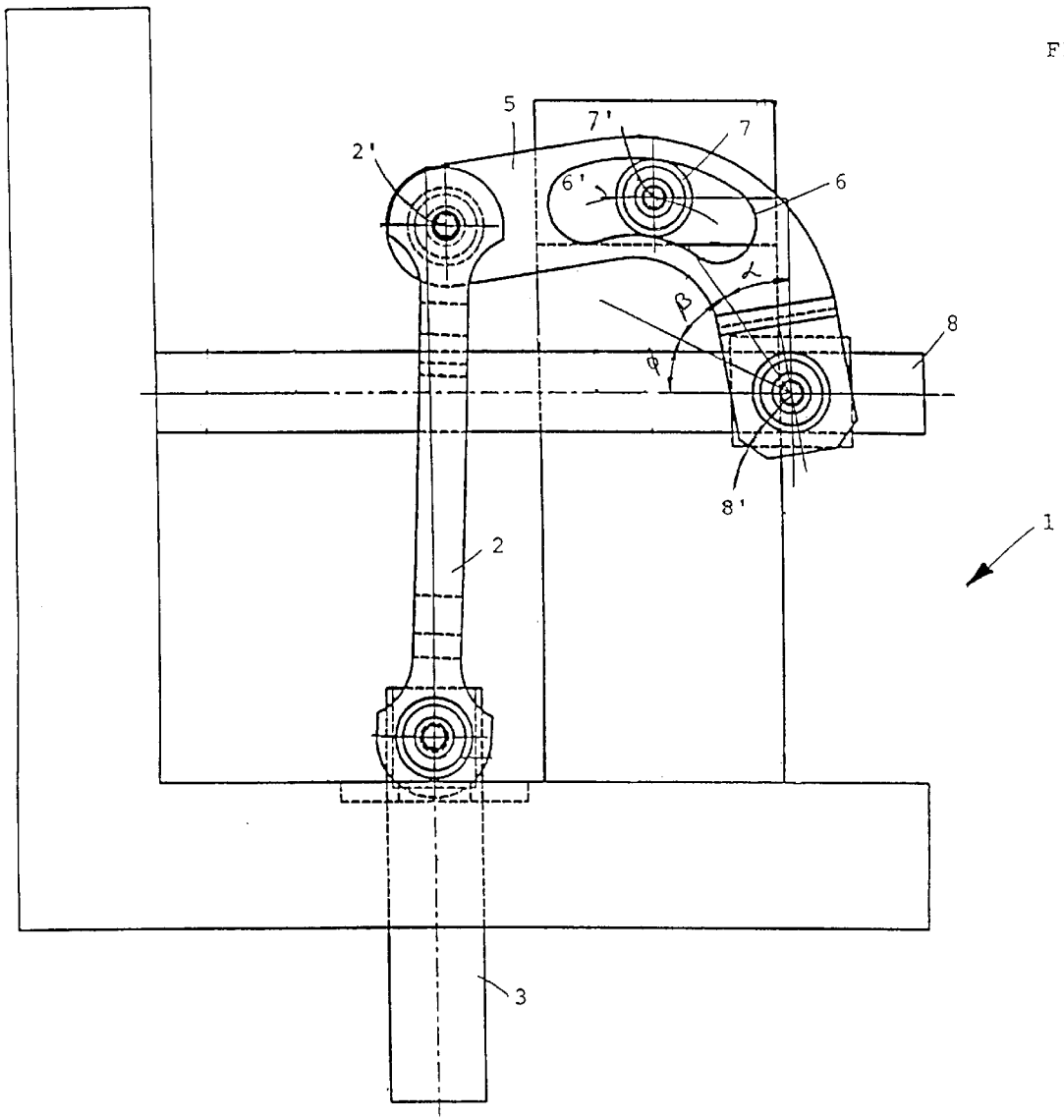
Figure 2:
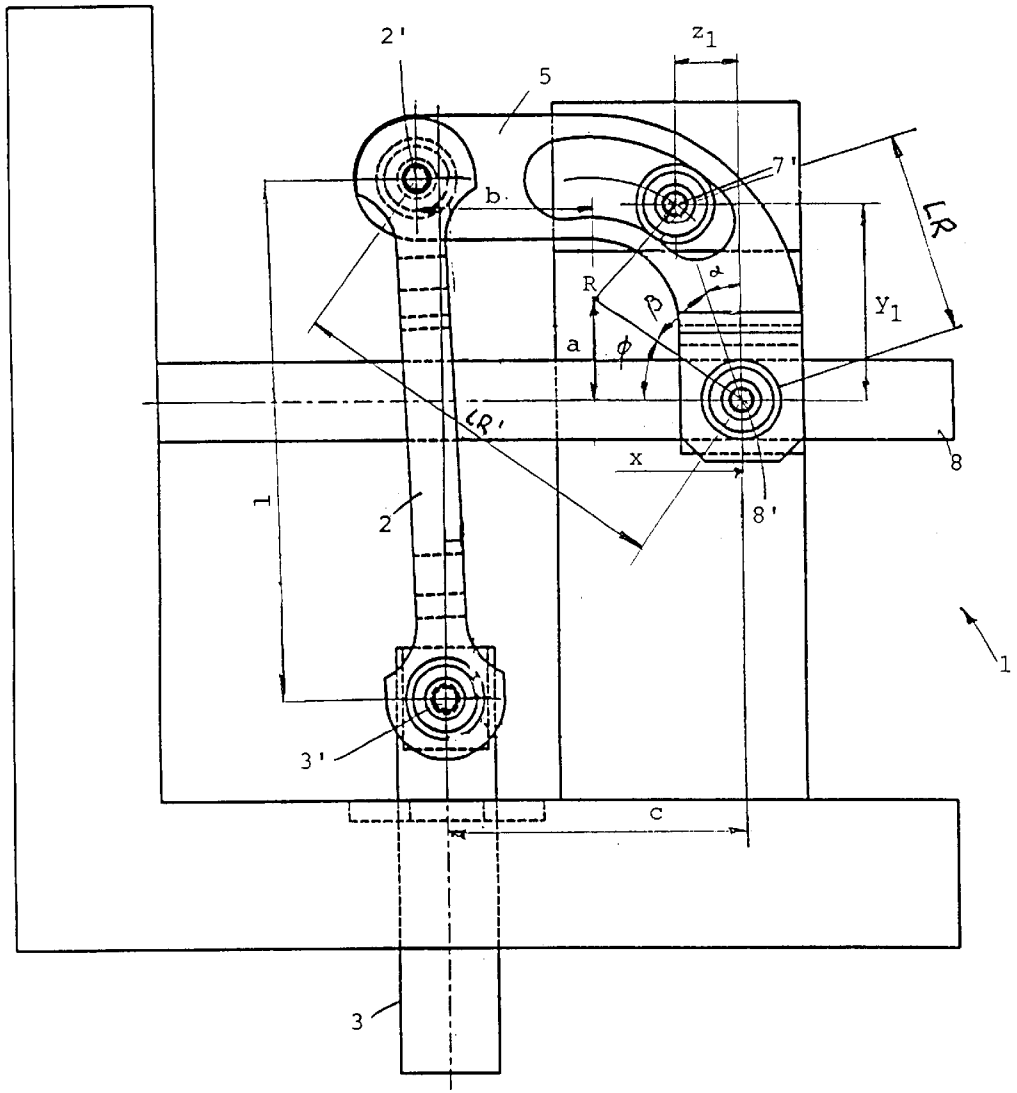
FIG. 2 shows a view of an arrangement according to FIG. 1, wherein the drive part is in a middle, or zero position, respectively.
Figure 3:
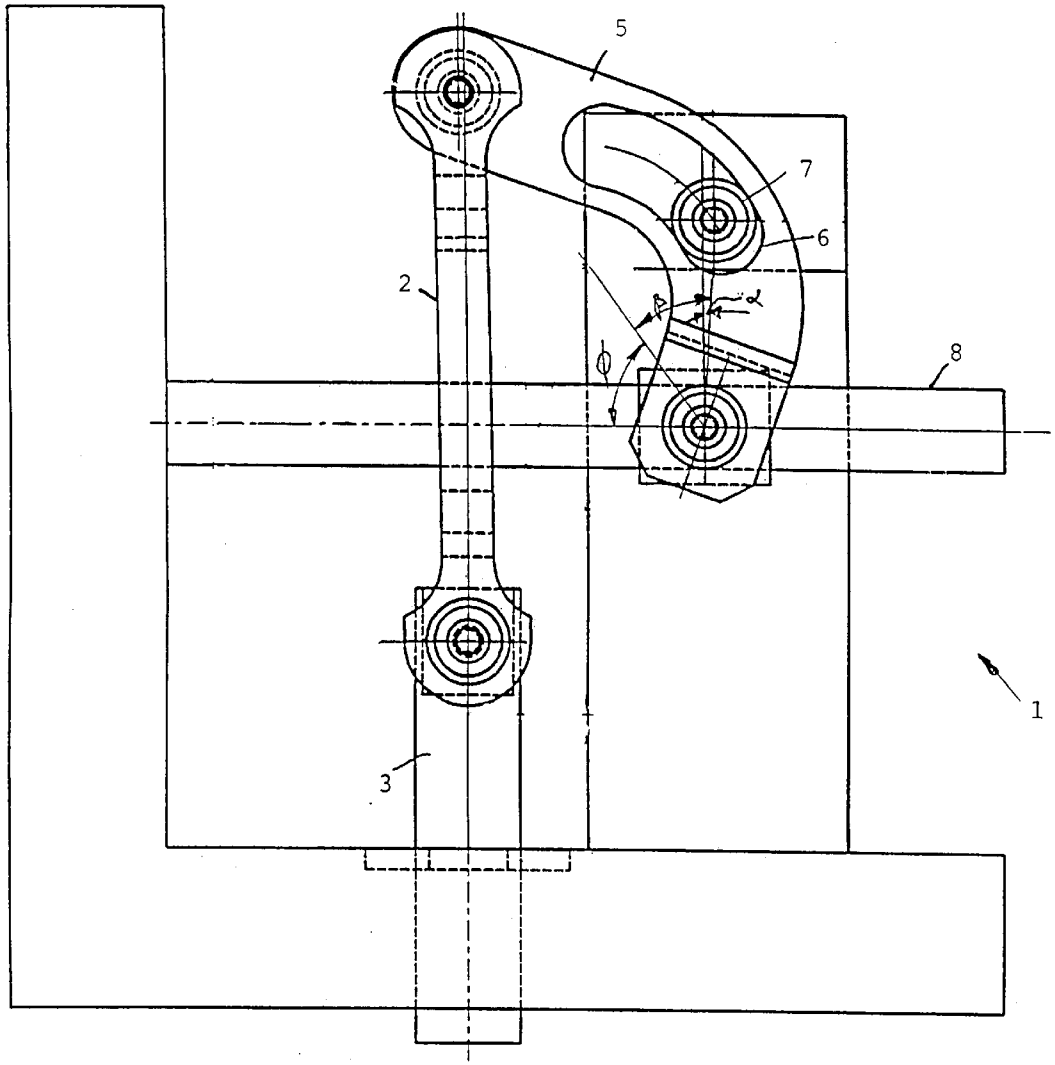
FIG. 3 shows a view of the arrangement according to FIGS. 1 and 2, wherein the drive part is in an upper end position.
Figure 6:
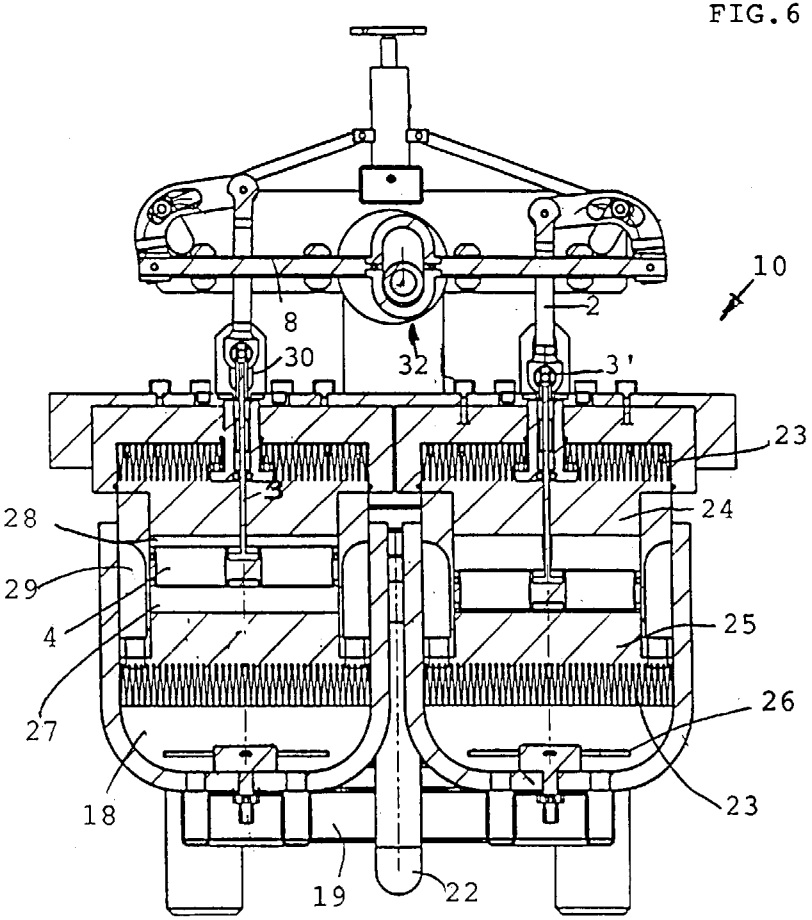
FIG. 6 shows a sectional representation according to line VI—VI of FIG. 5.

In FIGS. 1 to 3, an arrangement 1 for the controlled conversion of linear movements is shown, wherein a connecting rod 2 working as drive part is provided which is articulately connected to a piston rod 3 of a displacement piston 4 of a Stirling engine (cf. FIG. 6). Via an axle 2', the connecting rod 2 furthermore is articulately connected to a lever 5 which has a given control curve in the form of a connecting link 6 in which a roller 7 freely rotatable about an axle 7' and serving as a pivot point for lever 5 (subsequently, therefore, also being termed "roll-lever") is provided. The other end of the lever 5, which is substantially angled by 90°, is articulately connected about an axis 8' to a driven rod 8 to which the linear movement of the displacement piston rod 3 is transmitted. The driven rod 8 in turn is linearly mounted, yet turned by 90° with a view to the linear movement of the displacement piston rod 3.

As is visible from FIGS. 1 to 3, the bearing point of lever 5, depending on the position of the displacement piston rod 3, or of the connecting rod 2, respectively, moves along a curve 6' defined by the connecting link 6.

One of the essential parameters for determining the transmission of movement between the displacement piston rod 3 and the driven rod 8 is the distance LR (cf. FIG. 2) between the axis of rotation 8' between be lever 5 and the driven rod 8 and the axis of rotation 7' on which roller 7 is rotatably mounted. This distance LR can be expressed as $$LR(x)=\sqrt{y_1^2+(z_1+x)^2},$$

wherein x is the horizontal position of the axis of rotation 8' (and, thus, the displacement of the driven rod 8), $y_1$ is the vertical distance between the axes of rotation 8' and 7', and $z_1$ is the horizontal distance between the two axes of rotation 8', 7'.

Furthermore, the angle α enclosed by the imaginary connecting line between the axes of rotation 7', 8' to the vertical line, is important for the transmission of movement, and this angle α can be expressed by $$\alpha(x) = \arctan\frac{z_1 + x}{y_1},$$

whereas the change Δα of this angle can be indicated as $$\Delta\alpha = \arctan\frac{z_1 + x}{y_1} - \arctan\frac{z_1}{y_1},$$

with the intermediate or zero position shown in FIG. 2, in which one leg of the lever 5 is horizontal and the other leg of lever 5 is vertical, being taken as a reference.

Furthermore, the angle β between the connecting line between the axes of rotation 7', 8' and the connecting line between the axes of rotation 7', 2' is of importance for the transmission of movement, wherein $$\beta(x) = \arccos\frac{LR(x)^2 + a^2}{2\sqrt{a^2 + R^2 * LR(x)}},$$

or $$\beta(0) = \arccos\frac{y_1^2 + z_1^2 + a^2}{2\sqrt{a^2 + R^2}\sqrt{y_1^2 + z_1^2}}, \text{ respectively,}$$

and $$\Delta\beta=\beta(x)-\beta(0),$$

with R being the adjustable rolling radius of roller 7 and a being the vertical distance of the imaginary center of the rolling radius from the middle line of driven rod 8. Furthermore, the position of the axis of rotation 2' is of importance, which is dependent on the respective positions of the drive rod, and driven rod, respectively, and thus can be expressed as $$x'(x)=-LR'*\cos\phi(x)+x$$

and $$y'(x)=LR'*\sin\phi(x), \text{ respectively,}$$

wherein the angle ϕ, with the assistance of the difference angles Δα and Δβ, respectively, can be expressed as $$\phi(x)=\phi(0)-\Delta\alpha-\Delta\beta,$$

wherein in the intermediate position $$\phi(0) = \arctan\frac{R + a}{R + b},$$

and b is the horizontal distance between the imaginary roll-circuit center R and the axis 2' in the intermediate position. LR' is the distance between the axes of rotation 8' and 2', and thus can be expressed as $$LR'=\sqrt{(R+a)^2+(R+b)^2}.$$

With the assistance of the axis of rotation 3' between the displacement piston rod 3 and the connecting rod 2, the position of the displacement piston rod 3 can be expressed as $$p(x)=\sqrt{l^2-(c+x'(x))^2}+y'(x)$$

wherein the axis of rotation in its position shown in FIG. 2 is present in the position $$p(0)=\sqrt{l^2-(c-b-R)^2}-(a+R)$$

and wherein l represents the length of connecting rod 2 and c indicates the horizontal distance of axis 8' in the reference position from the middle axis of the displacement piston rod 3.

In FIG. 3, the displacement piston rod 3 is illustrated in its uppermost position, it being visible that roller 7 comes to rest against the rim of connecting link 6 neither in this extreme position nor in the extreme position illustrated in FIG. 1.

Figure 4:
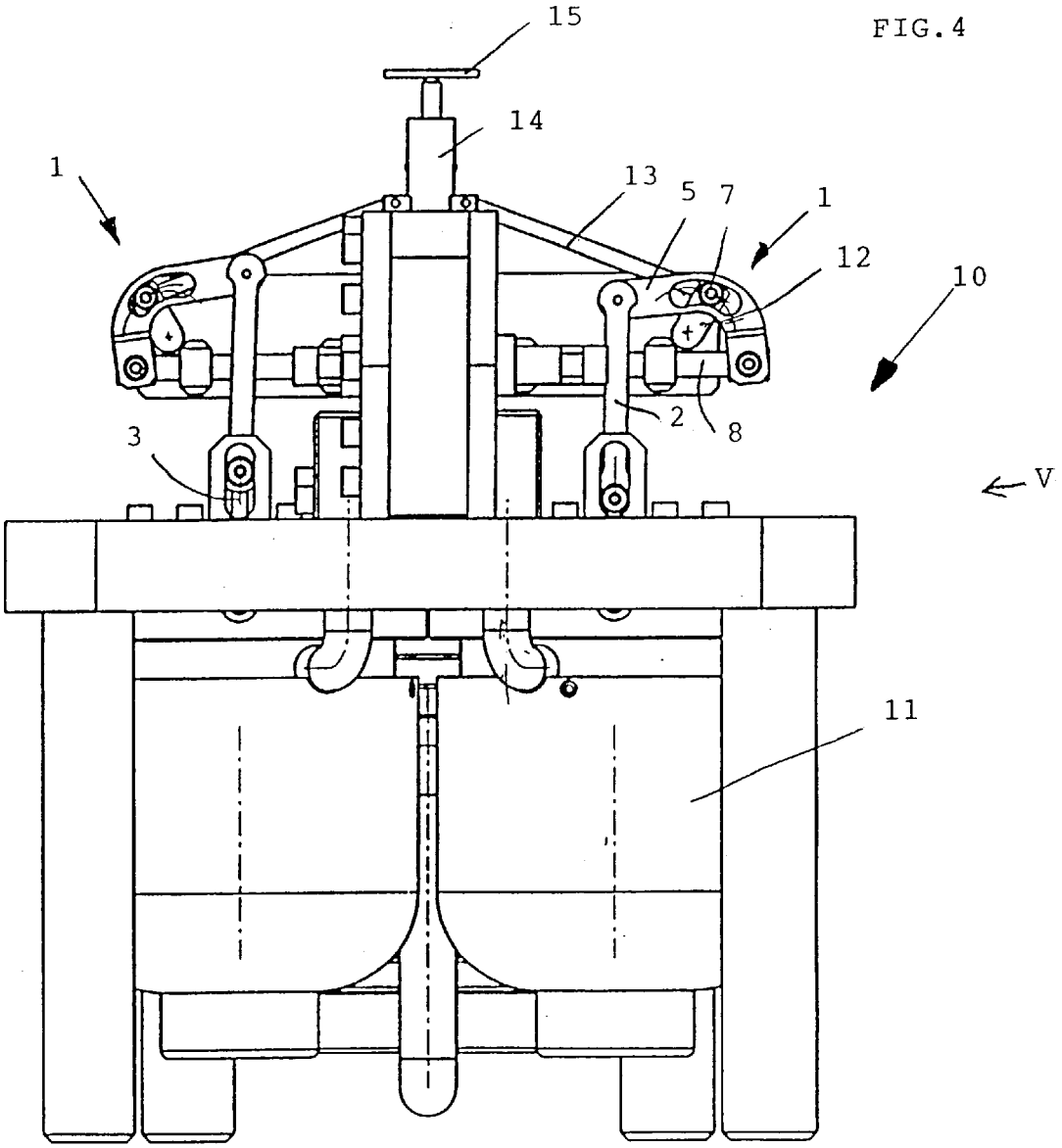
FIG. 4 shows a view of a Stirling engine with two displacement units and one arrangement each for controlling the reciprocating movement of a displacement piston.

In FIG. 4, a Stirling engine 10 comprising arrangements 1 for the controlled linear movement transmission from a respective displacement piston rod 3 to an associated driven rod 8 is illustrated. The Stirling engine 10 has two displacement units 11 in which one displacement piston 4 each is reciprocated. The movement described by the respective lever 5 can be changed by adjusting the position of roller 7 which is adjustable via a pivot arm 12. For adjusting the position of pivot arm 12, one linkage 13 each is provided which is adjustable with the assistance of a common spindle drive 14 via an adjustment wheel 15. By upward rotation of the adjustment wheel 15, the position of rollers 7 can be changed such that a power change will result therefrom, as can be seen from FIGS. 11*a* to 11*d*.

Figure 5:
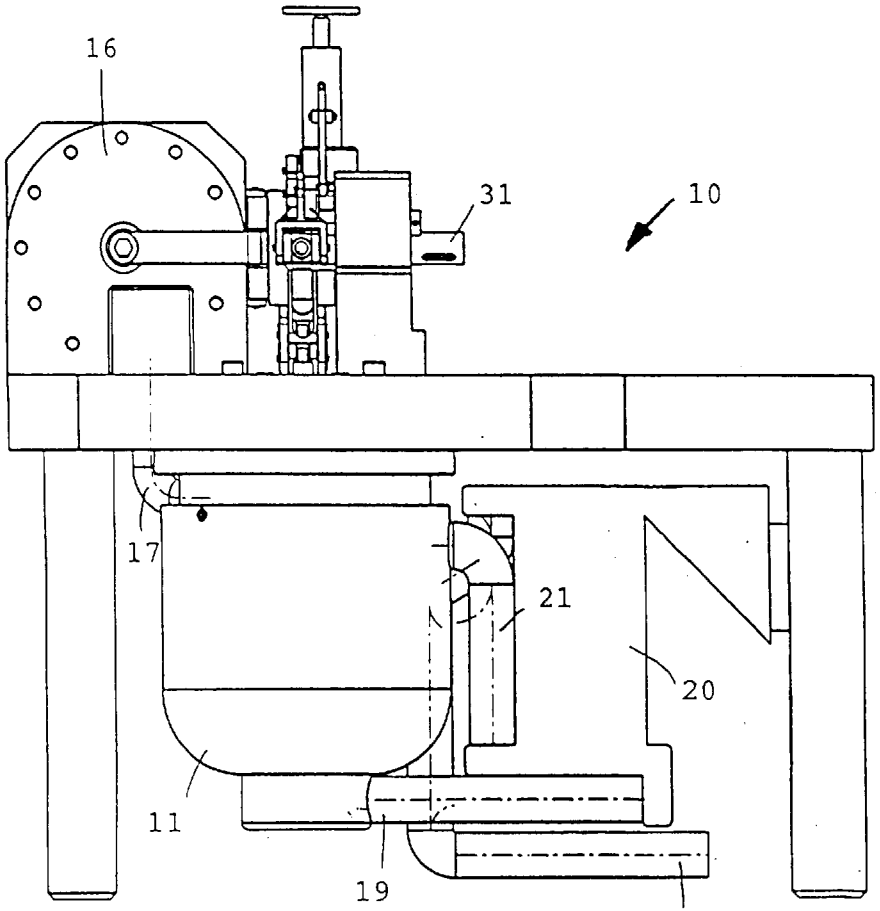
FIG. 5 shows a side view of the Stirling engine according to arrow V of FIG. 4.

In the FIG. 5 side view of the Stirling engine 10, the working cylinder 16 can be seen which is fed via a duct 17. Via a duct 19 and via a heat exchanger 20, fresh air heated with the assistance of the heat of the waste gas supplied via a duct 21 is introduced for combustion purposes into a combustion space 18 (cf. FIG. 6) of the displacement unit 11, which fresh air, after having passed the heat exchanger 20, can escape into the environment via duct 22.

In FIG. 6, a section of the Stirling engine 10 according to line VI—VI of FIG. 5 is shown; there, a wave-shaped section 23 of the cooler surfaces 24 and heater surfaces 25, respectively, can be seen, with these heat exchanger surfaces 24, 25 possibly being made of ceramics, e.g. The heater surfaces 25 follow upon the combustion spaces 18, in which one burner 26 each is provided for the heating, or combustion, respectively, of the already pre-heated fresh air introduced via ducts 19. The displacement piston 4 shifts the working gas between a hot chamber 27 and a cool chamber 28, the middle part 37 of the displacement piston 4 containing the regenerator (cf. FIG. 5).

Furthermore, it can be seen in FIG. 6 that the connecting rod 2 is connected by a hinge 3' guided in a straight-line guide 30 so as to guide the displacement piston rod 3. To transmit the movement from the driven rod 8 to a crankshaft 31 (cf. FIG. 5), a type of crank drive 32 (FIG. 6) is provided.

Figure 7:
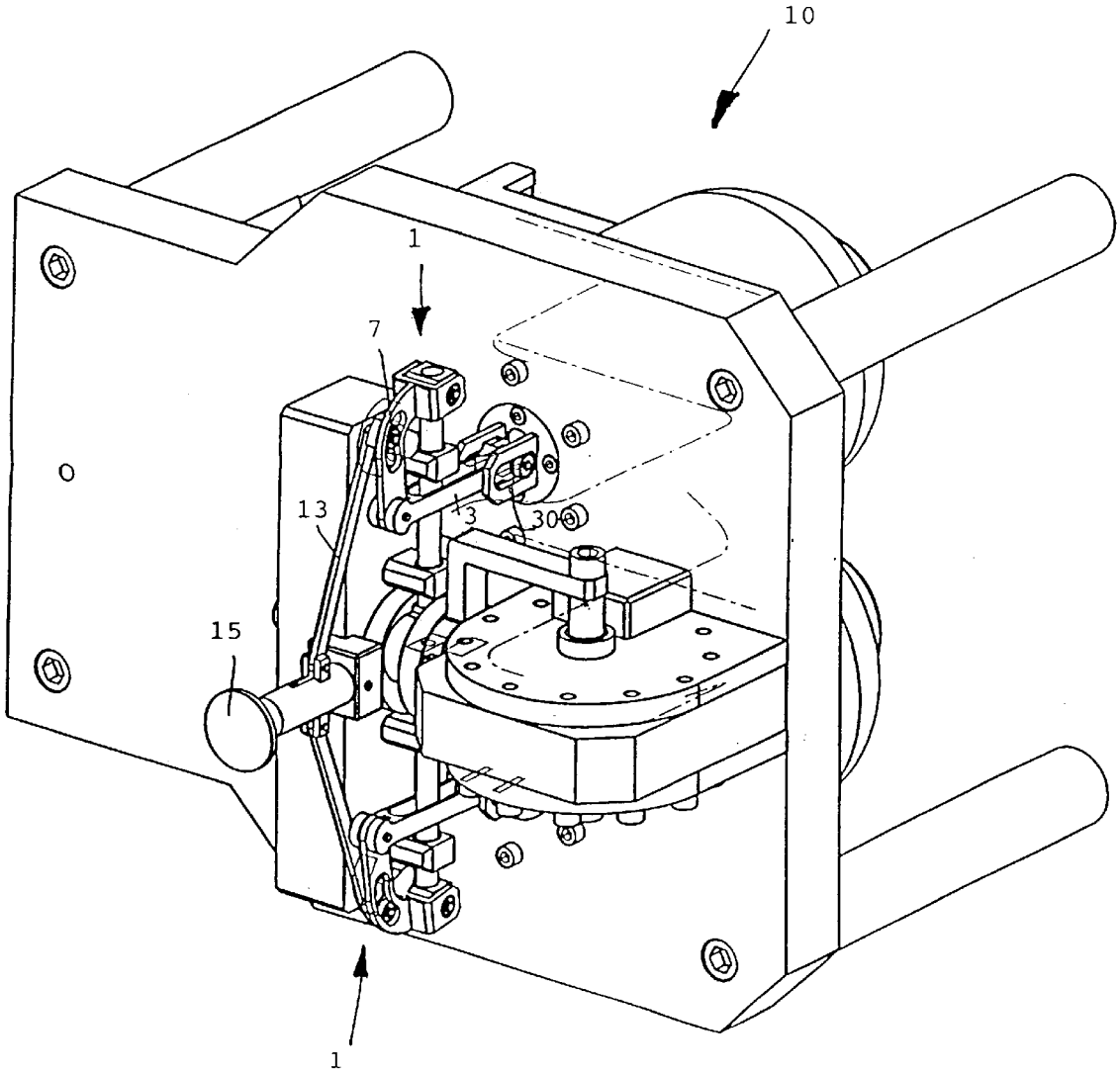
FIG. 7 shows a perspective view of the Stirling engine according to FIGS. 4 to 6.

In FIG. 7, a perspective view of the Stirling engine 10 comprising the arrangements 1 associated with the displacement units 11 and provided for the controlled transmission of the linear movements of the connecting rods 3 is shown. Furthermore, the adjustment mechanism for the rollers 7 via rods 13 can be seen which, by rotating the adjustment wheel 15, allows for an adjustment of the position of the rollers 7, whereby in turn a power control of the Stirling engine 10 by the altered reciprocating movement of the displacement piston 4 is provided.

Figure 8:
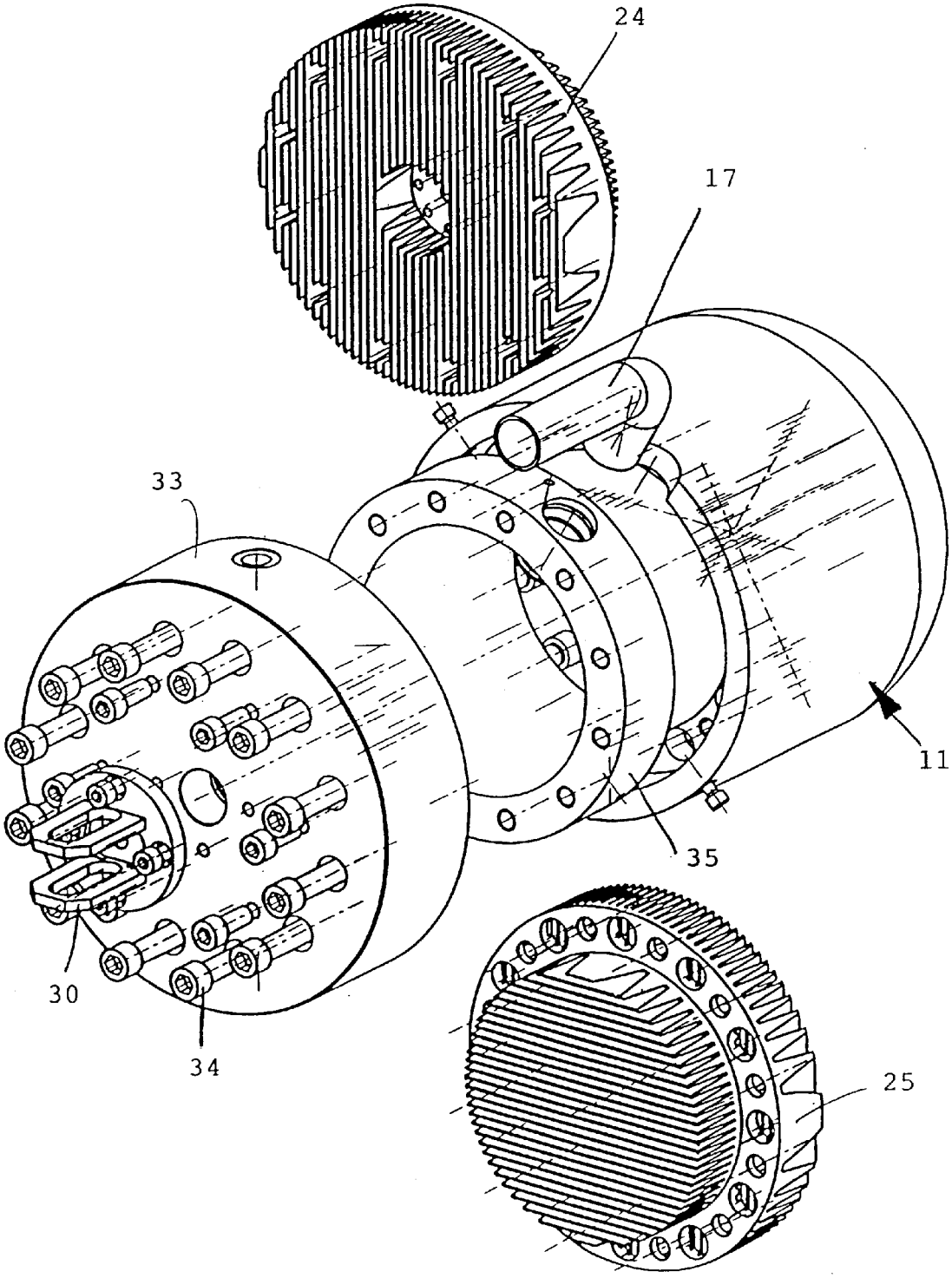
FIG. 8 shows an exploded view of a displacement unit of the Stirling engine with cooler and heater surfaces, respectively, which have a wave-shaped section.

In FIG. 8, an exploded view of the displacement unit 11 is shown. In the cooler lid region, substantially the straight-line guide 30 for receiving the articulated connection between the displacement piston rod 3 and the connecting rod 2 is shown, which straight-line guide is screwed to the cooler-side lid 33. The heat exchanger surface 24 provided for cooling is connected to the cooler-side lid 33 via several screws 34. Furthermore, a cylinder 35 is provided on which the duct 17 is provided for the spatial connection with the working cylinder 16. Just like the cool heat exchanger surface 24, the hot heat exchanger surface 25 has a wave-type surface section on either side for stability purposes which preferably is rotated by 90°, so as to obtain as large a surface as possible, which enhances a heat exchange between the hot and the cool surface, respectively, and the displacement chamber.

Figure 9:
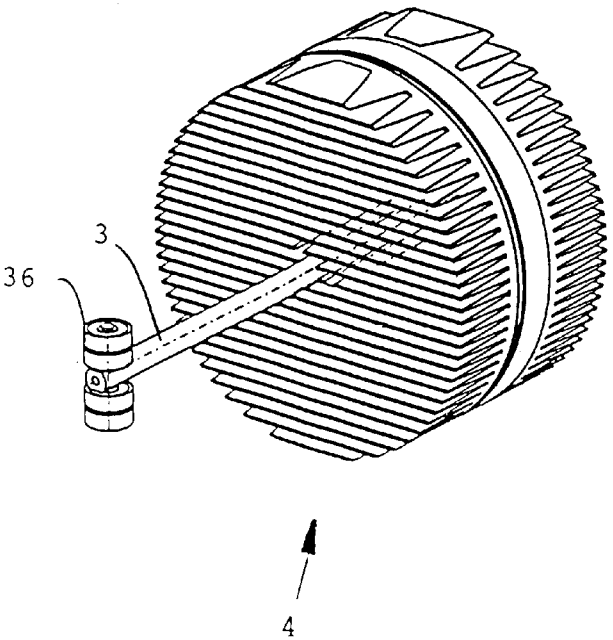
FIG. 9 shows a perspective view of a displacement piston for a reciprocating movement in a displacement unit according to FIG. 8.
Figure 10:
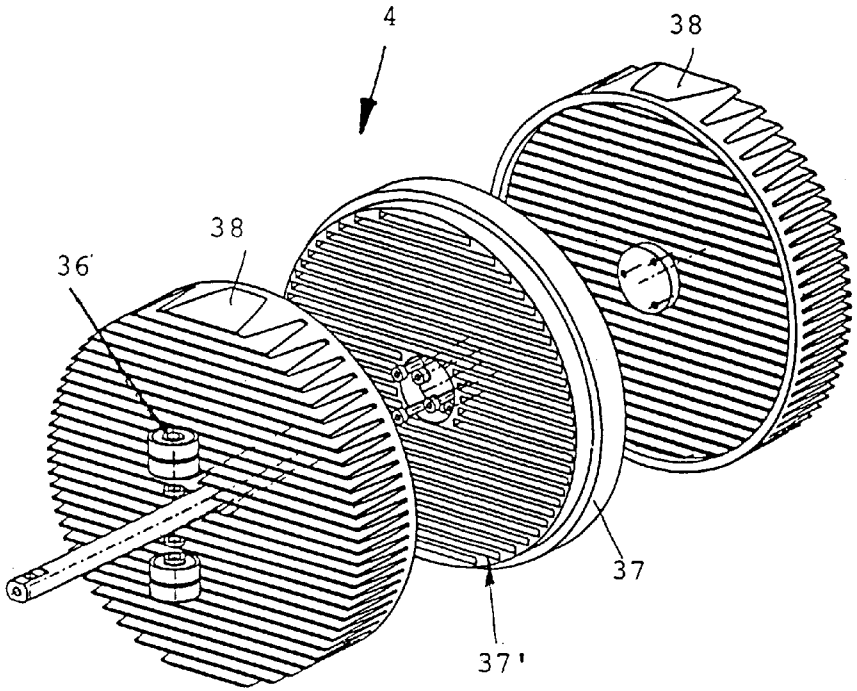
FIG. 10 shows an exploded view of the displacement piston according to FIG. 9.

From FIGS. 9 and 10 it can be seen that a roller 36 is provided at the connecting-rod-side end of the displacement piston rod 3, which roller slides in the straight-line guide 30, whereby the linear guidance of the displacement piston 4 is ensured. The displacement piston 10 consists of three individual parts, section halves 38 each being screwed to a regenerator disc 37, which section halves have the aforementioned wave-type section provided for mutual engagement with the wave-type section of the heat exchanger surfaces 24 and 25, respectively. The regenerator disk 37 which may, e.g., be made of ceramics, has slot-shaped cavities 37' in which a regenerator material, e.g. sintered steel wool having a porosity of approximately 60–70%, is embedded.

FIGS. 11*a* to 11*d* show, in four graphs each, four different adjustments of the position of the roller 7 supporting the roll-lever 5. Each one of FIGS. 11*a* to 11*d* includes a p-V diagram I, a graph II of the changing volumes during a complete reciprocation of the working piston and of the displacement piston, respectively, a graph III of the piston positions of the working piston as well as of the displacement piston over a complete cycle, and a standardized illustration IV of the piston positions of the working and displacement pistons as regards their extreme positions made possible in accordance with the adjustment of the roller 7.

Figure 11A:
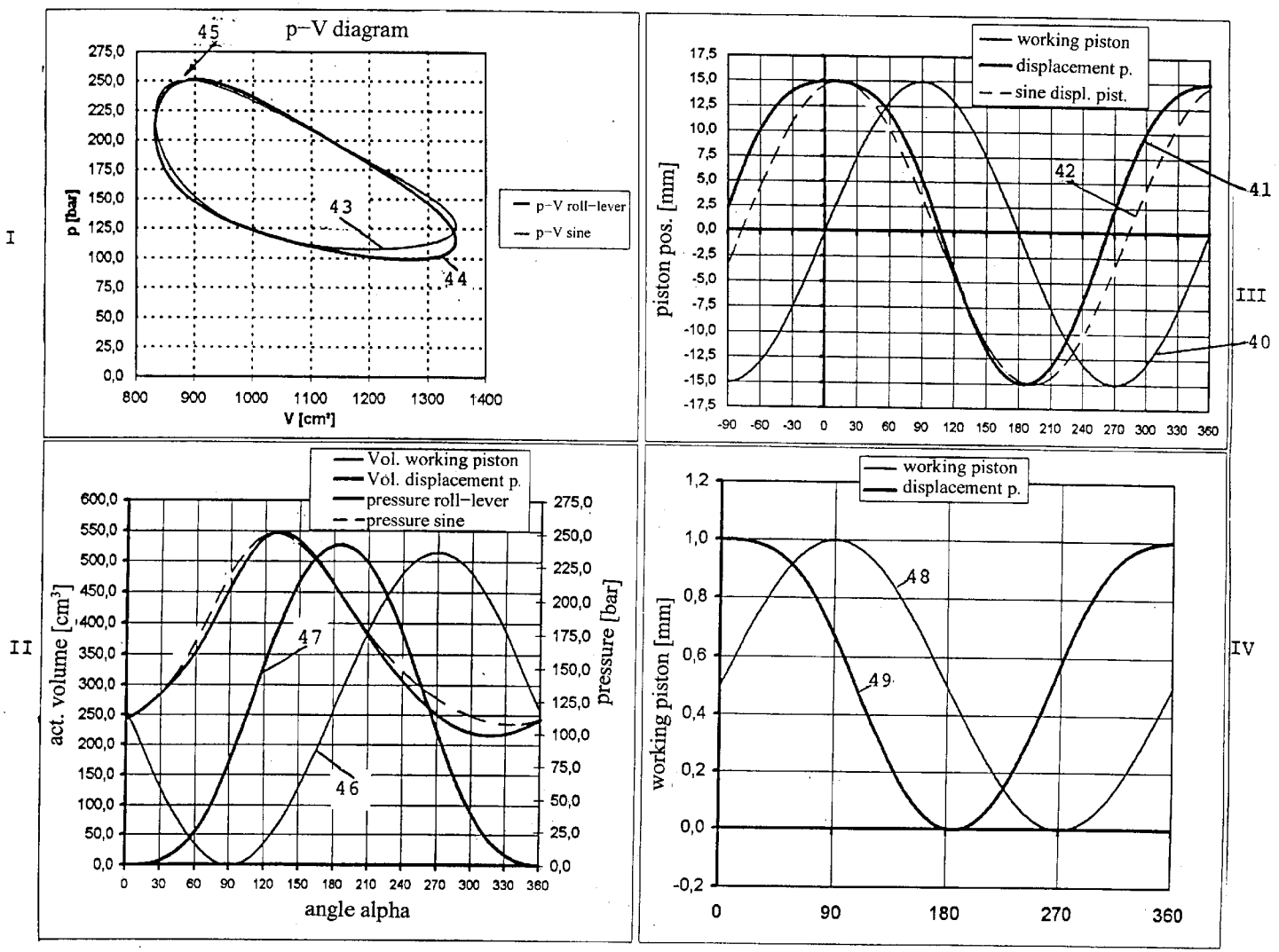

From FIG. 11*a* it can be seen that a power increase is possible with a position of the roller 7 pivoted very much out of the vertical, in which the phase shift between the course 40 of the working piston and the course 41 of the displacement piston has been reduced from 90° to approximately 85° (cf. illustration III), whereby a maximum pressure 45 (cf. diagram I) which is the same as compared to a normal sine course 42 is attained, and the power in the example illustrated in FIG. 11*a* can be increased to 102.6 kW (cf. computer-simulated p-V-course 44 with roll-lever control) as compared to 97.6 kW (cf. computer-simulated p-V-course 43) with a conventional sine course of the displacement piston 42.

From graph II it can be seen from the course of the working volume 46 and of the displacement volume 47 that in the adjusted position illustrated in FIG. 11*a*, the entire volumes of the working and displacement pistons are utilized. Moreover, in the standardized graphs IV of FIGS. 11*a* to 11*d*, the relative piston course 48 of the working piston and the relative piston course 49 of the displacement piston are illustrated.

Figure 11B:
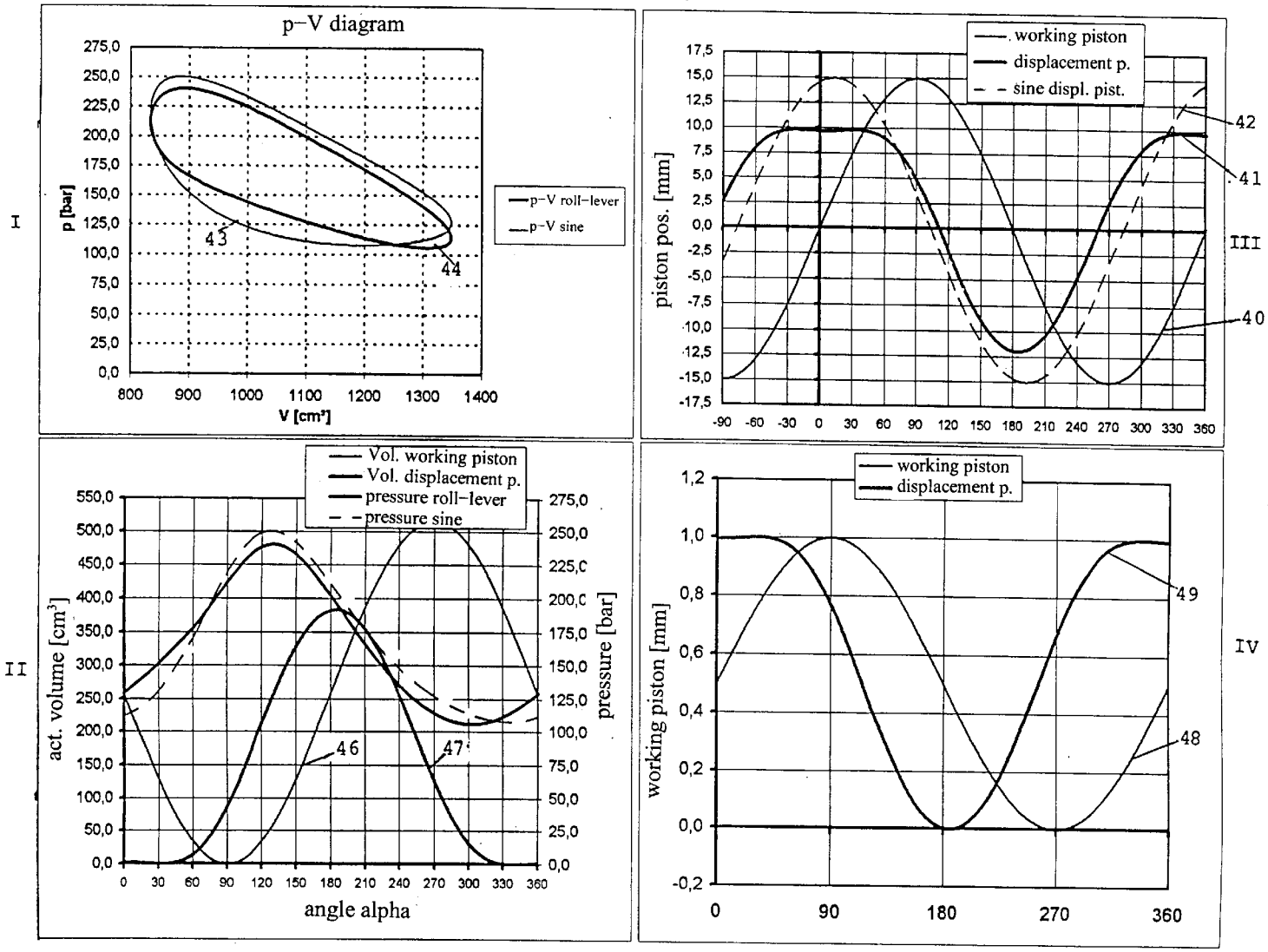
Figure 11C:
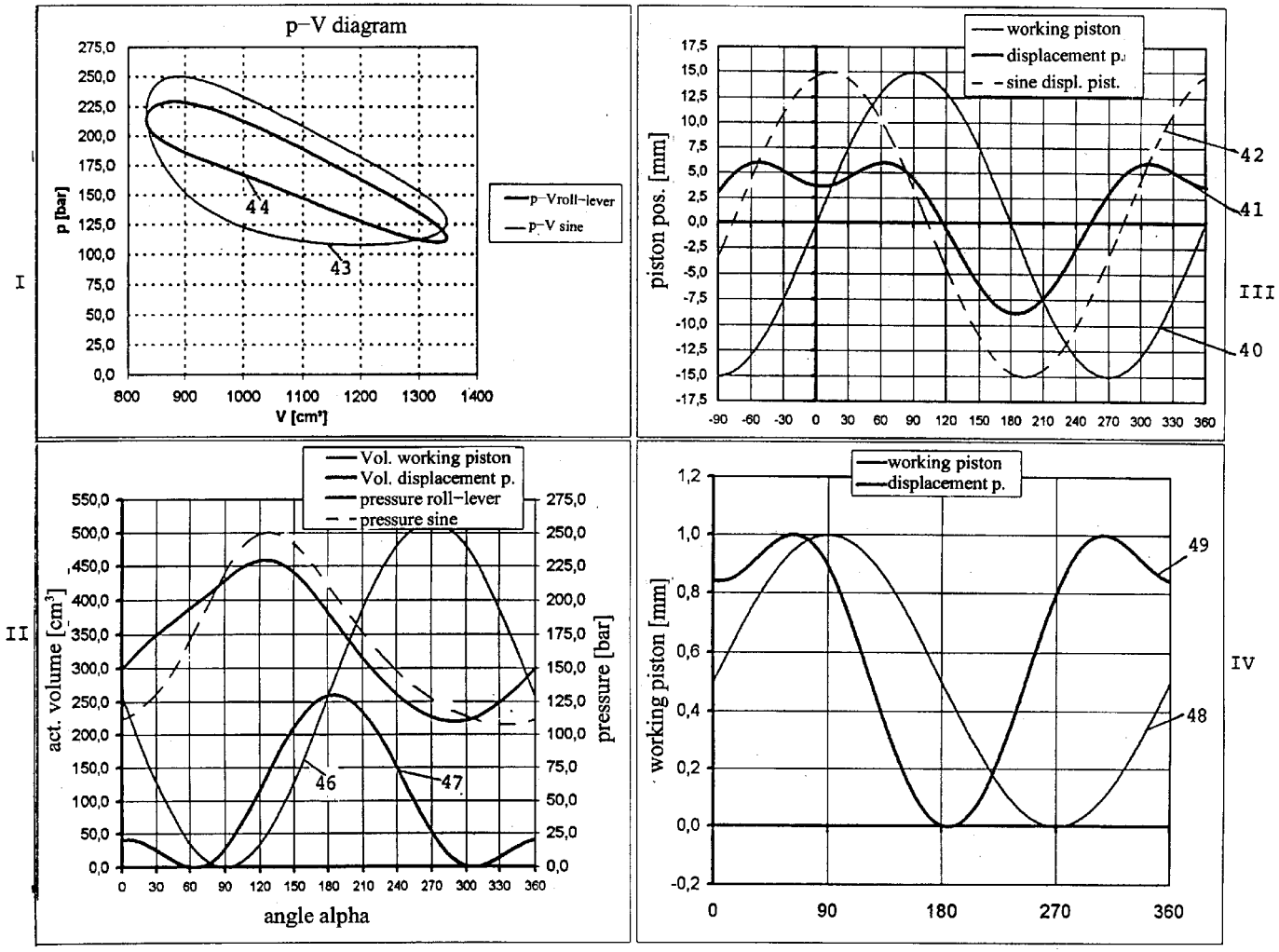
Figure 11D:
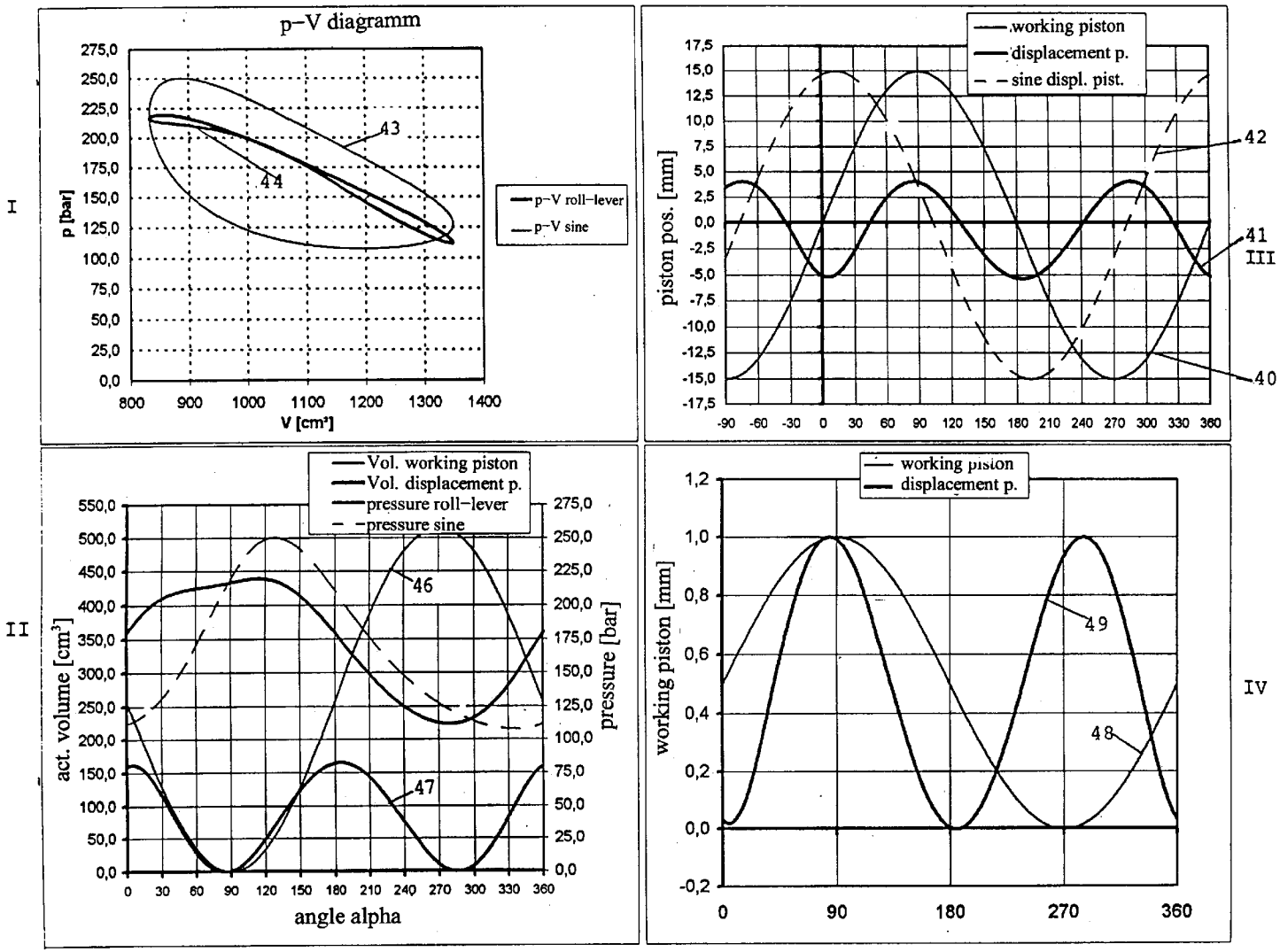

At an upward rotation of the adjustment wheel 15, by which the roller 7 is displaced towards a vertical position, as is visible from FIGS. 11*b* to 11*d*, depending on the position of the roller 7, the maximum stroke of the displacement piston 4 is reduced (cf. graphs III in FIGS. 11*b* and 11*c*), whereby the active volume of the displacement piston 4 is reduced (cf. graphs II), and thus an efficiency-neutral power control of the Stirling engine 10 is achieved.

From FIG. 11*d*, in graph III thereof, it is visible that the stroke of the displacement piston can even be shifted into the negative range (curve 41), leading to a further reduction of the displacement volume (cf. illustration II in FIG. 11*d*), and thus to a further power reduction, an adjustment according to FIG. 11*d* resulting in a power reduction to 6.7 kW, cf. also the p-V diagram I in FIG. 11*d*.

FIG. 12 shows a view of a β-Stirling engine 50 with an arrangement 1 for the controlled conversion of linear movements, wherein fresh air is introduced via two blowers 51, via a duct 19, into a combustion space 18, which fresh air is heated via a heat exchanger 20 with the assistance of the heat of the waste gas supplied via duct 21. The waste gas supplied to the heat exchanger 20 subsequently leaves the β-Stirling engine 50 towards the environment via ducts 22.

In the partially broken away side view of the β-Stirling engine 50 in FIG. 13, the displacement piston 4 and a working piston 52 can be seen. The power produced by the β-engine 50 can be received at the crankshaft 53.

In FIG. 14, the β-engine 50 is shown in which the displacement piston 4 and the working piston 52 are provided in a shared cylinder 54, whereby in theory it is possible for approximately the entire gas mass to be in the hot space 55 during the expansion phase, and in the cold space 56 during the compression phase, respectively. Both, the displacement piston rods 3 and also the working piston rods 3' are connected to the roll-lever 5, the rollers 7' of the roll-lever 5' which are associated with the displacement piston rods 3 being rigidly arranged. On the other hand, the rollers 7 which are associated with the working pistons 52 are arranged to be displaceable with the assistance of a connecting link guide 57. For this purpose, a disk 59 including two spiral-shaped recesses 58 is provided in which the ends 13' of the linkages 13 located opposite the rollers' 7 are received. By this, the position of the rollers 7 in the roll-levers 5 can be changed when a plate 60 receiving the ends 13' is rotated. With the help of the roll-levers 5, 5', thus a discontinuous movement of the displacement pistons 4 and of the working pistons 52 is achieved, whereby the thermal circle process can be passed in a more ideal manner as compared to a sine-shaped piston movement. By this, the mechanical efficiency obtainable is substantially increased. With the assistance of the connecting link guide 57 for adjusting the position of the roller 7 of lever 5, thus, an embodiment of simple construction for a dynamic stroke change can be obtained, particularly allowing for a nearly efficiency-neutral and rapid power regulation.

With the wave-type surface sections 23, as large heat exchanger surfaces as possible are obtained (cf. in this regard the description of FIG. 6). To cool the wave-type surface section of the working piston 52, supply and drain ducts for a coolant (not illustrated) are provided in both working piston rods 3', which coolant flows through both working piston rods 3'. Otherwise, the working piston 52 is constructed like the displacement piston 4 according to FIGS. 9 and 10 and therefore need not be further described.

In FIG. 15, a β-Stirling engine 50 according to FIG. 14 is shown, yet the position of the rollers 7 in the roll-levers 5 has been changed by aid of the connecting link means 57. In this manner, a substantially efficiency-neutral and, moreover, rapid power regulation of the β-engine 50 can occur (in this respect, cf. the graphs of FIGS. 19*a* to 19*d*).

With the β-Stirling engine 50 shown in FIG. 16, the rollers 7 of the roll-lever 5 are in an inner extreme position, resulting in a power-minimizing position of the rollers 7. For this purpose, the ends 13' are inserted in spiral-shaped connecting links 58 of disk 59 as far as to an inner stop. The power minimization resulting therefrom can be seen from the graphs shown in FIG. 19*d*.

In FIG. 17 a perspective, broken away view of the β-Stirling engine according to FIGS. 12 to 16 is shown, wherein, in particular, the compact arrangement of the roll-levers 5 and of the heat exchanger 20 are visible. With the help of a linear crank 61, the linear movements introduced by the driven rods 8 of the arrangements 1 are converted into a rotational movement of the crankshaft 53.

As can be seen from the exploded illustration of FIG. 18, only one centrally arranged displacement piston rod 3 is provided for the displacement piston 4, whereas the working piston 52 is connected to the roll-levers 5 via the two laterally arranged working piston rods 3' via connecting rods 2 (cf. FIG. 15).

In FIGS. 19*a* to 19*d* four different adjustments of the position of the roller 7 supporting the roll-lever 5 are each shown in four graphs, in accordance with the β-Stirling engine 50 shown in FIGS. 12 to 18. There, each one of FIGS. 19*a* to 19*d* includes a p-V-diagram I, a graph II of the changing volumes during a complete reciprocation of the working piston and of the displacement piston 52, 4, respectively, a graph III of the piston positions of the working piston 52 as well as of the displacement piston 4 over a complete cycle, and a graph IV of the course of the torque of a single cylinder-β-Stirling engine, a two-cylinder-β-engine according to FIGS. 12 to 18, and a four-cylinder-β-engine.

Figure 19A:
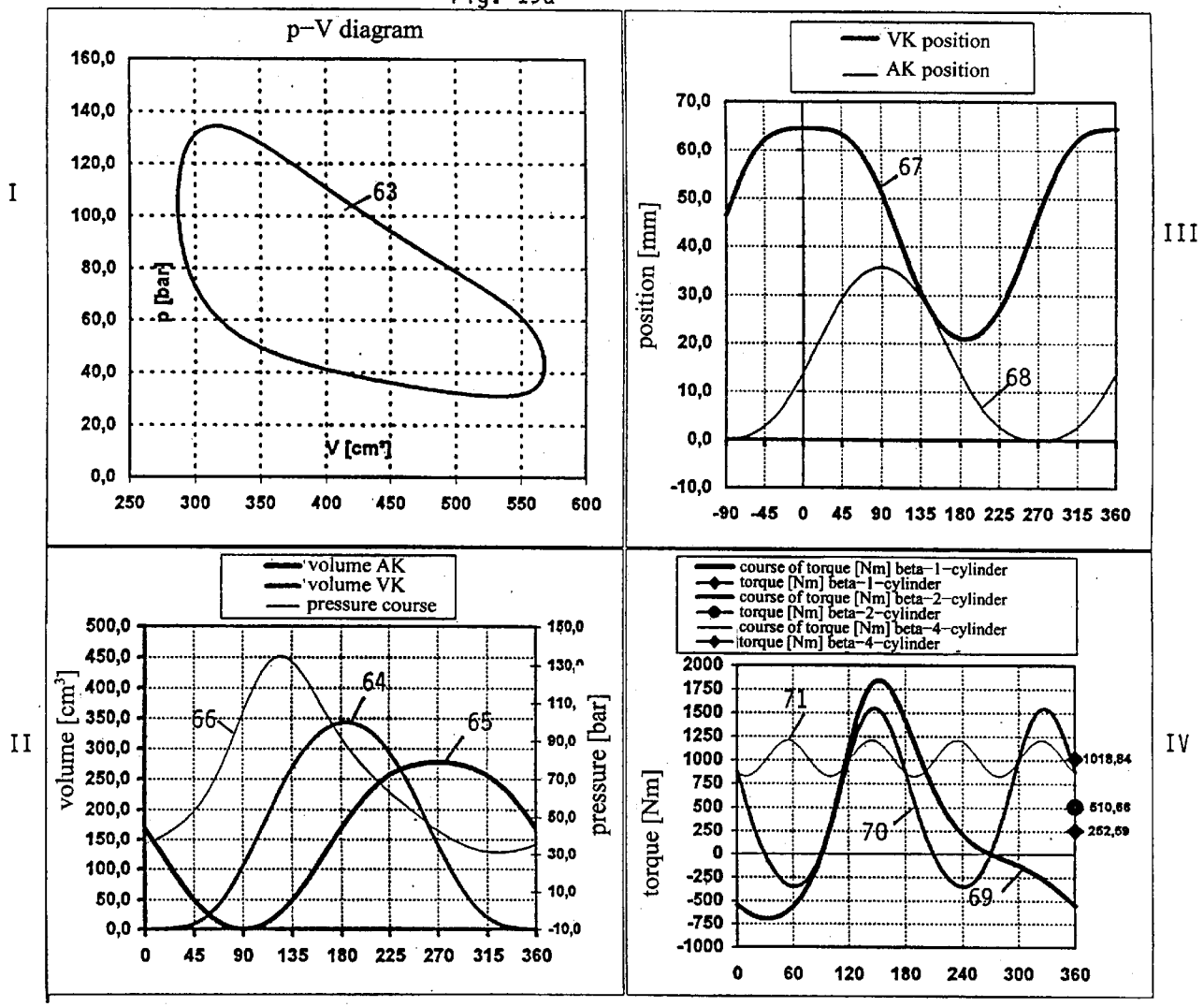

From FIG. 19*a* it can be seen that a very high thermal efficiency results at the position of the roller 7 in the lever 5 according to FIG. 14, wherein according to the computer-simulated p-V-course in a two-cylinder β-engine according to FIGS. 12 to 18, a power of approximately 159 kW will result.

From graph II, it can be seen from the course 64 of the displacement piston (VK) 4 and from the course 65 of the working piston (AK) 52 that in the adjusted position shown in FIG. 14, the entire volumes of the working piston 52 and of the displacement piston 4 are utilized. Moreover, from the pressure course 66 it can be seen that no excessive pressure peaks are produced, whereby advantageously no excessive demands are made on the mounting of roller 7.

In accordance with the complete utilization of the working piston volume and of the displacement piston volume, respectively, according to graph II, it can be seen from graph III, by way of the course 67 of the position of the displacement piston and the course 68 of the position of the working piston that both pistons execute a maximum stroke.

By way of graph IV it can be recognized that by doubling the number of cylinders of the β-Stirling engine, a more even course of the torque can be attained. Accordingly, the course 69 of the torque of the single-cylinder-β-engine has the highest amplitude, the two-cylinder-β-Stirling engine 50 shown in FIGS. 12 to 18 has an already more even course 68 of the torque, and with the help of a four-cylinder-β-Stirling engine a relatively uniform course 71 of the torque can be achieved.

Figure 19B:
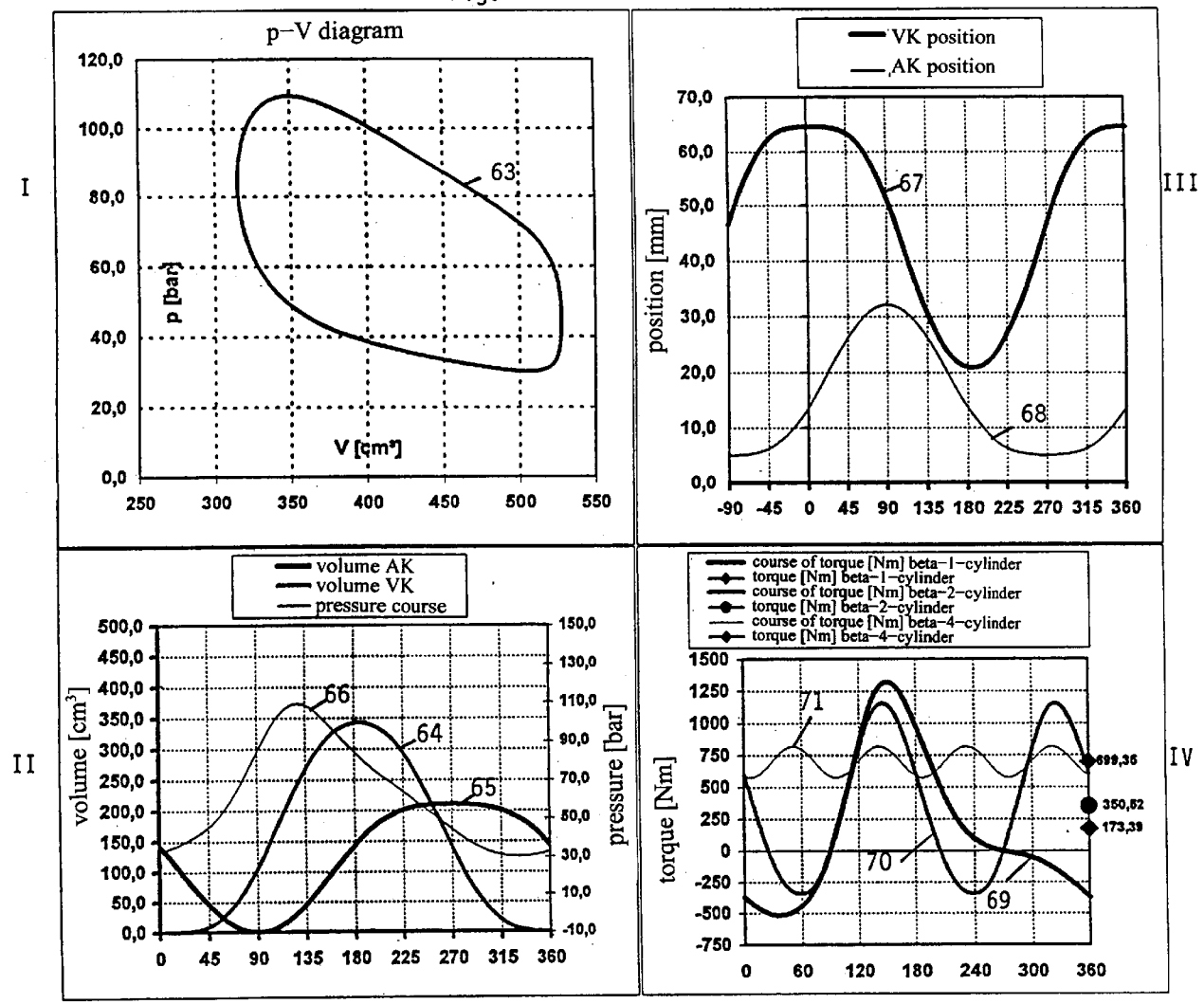
Figure 19C:
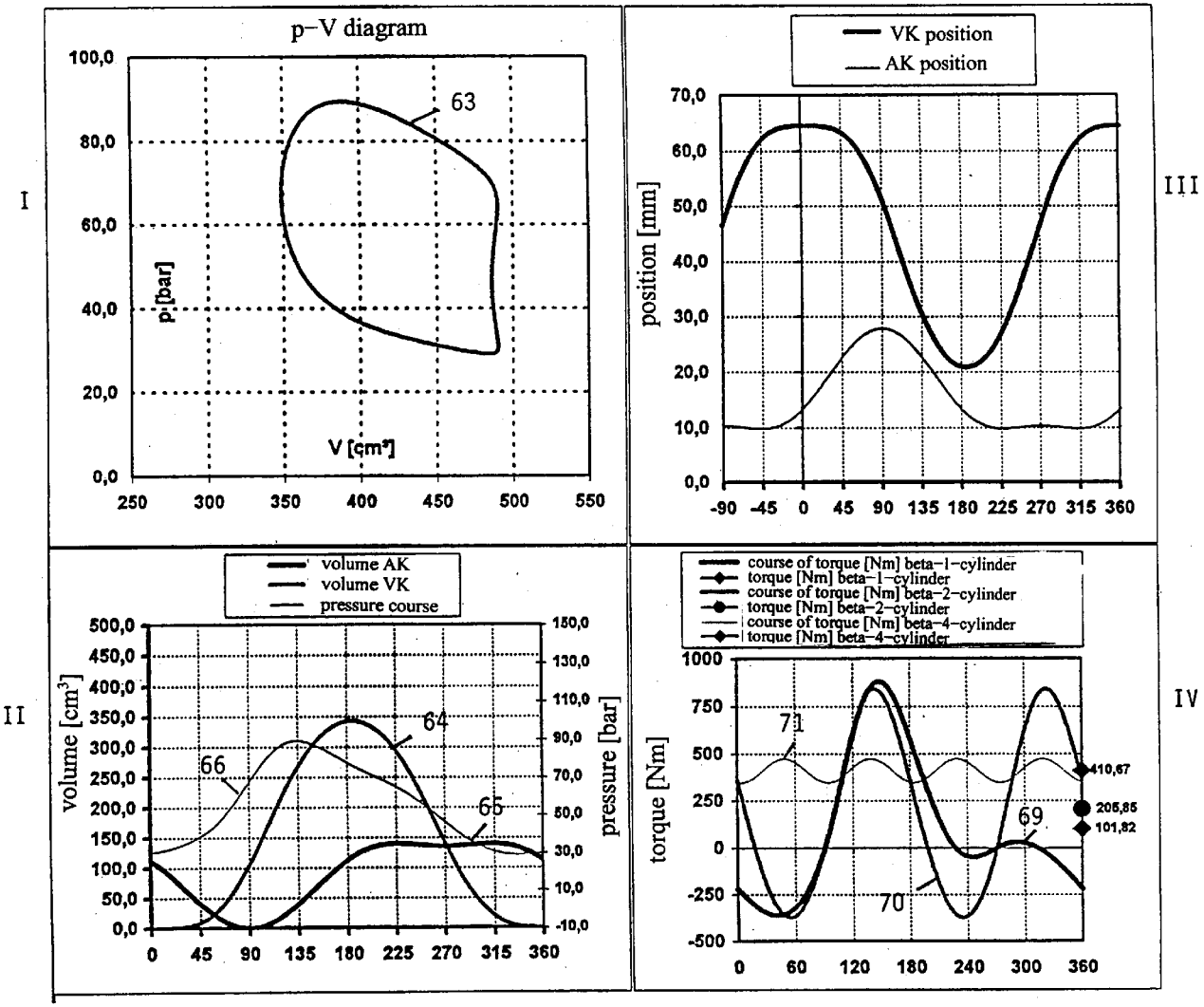

In FIGS. 19*b*, 19*c*, graphs pertaining to intermediate positions of the roller 7 of the roll-lever 5 are shown, wherein these positions can be adjusted in a simple manner with the help of connecting link guides 57. Depending on the position of the rollers 7, the power of the P-Stirling engine 50 will decrease, this also being visible from the graphs II, III of FIGS. 19*b*, 19*c*, due to the decrease of the working piston stroke 68 and, thus, to a reduction of the working piston volume 65. According to the computer-simulated p-V-course 63 according to FIG. 19*b*, this will result in a power of approximately 73 kW, and according to FIG. 19*c*, in a power of approximately 21 kW.

Figure 19D:
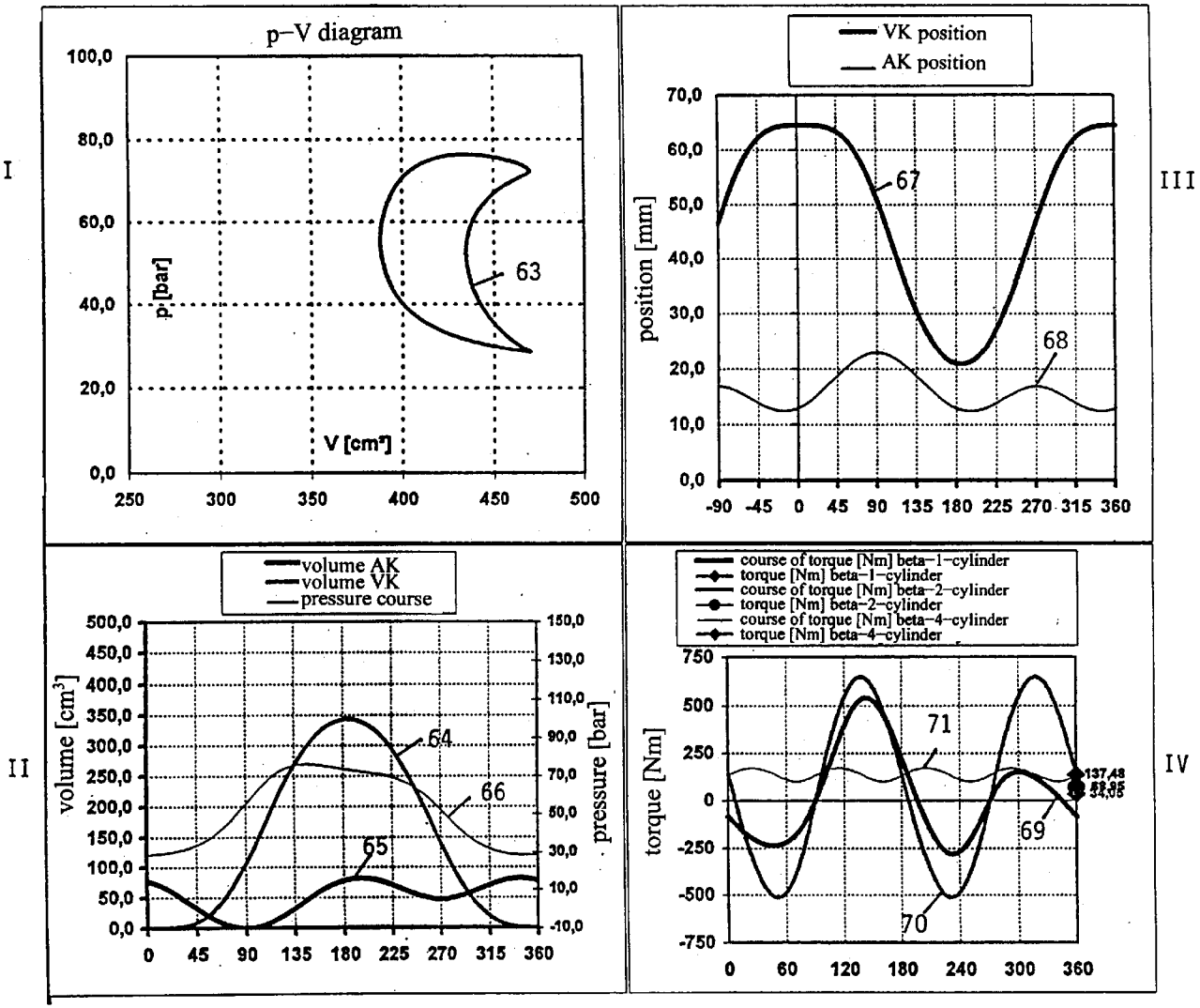

In FIG. 19*d*, the corresponding graphs I, II, III, IV pertaining to the power-minimizing adjustment of the rollers 7 illustrated in FIG. 16 are shown. In this position, merely a power of approximately 4 kW will be achieved. In graph II it is shown that the working piston volume 65 is greatly reduced as compared to the maximum power position illustrated in FIG. 19*a*, since—as visible in FIG. 19*d*-the maximum stroke 69 of the working piston 52 is greatly reduced. Of course, as is visible from FIG. 4, reduced torques will result with single, two and also four-cylinder-β-engines.

In FIGS. 20 and 21, a double-active four-cylinder Stirling engine 72 comprising arrangements 1 for the controlled conversion of linear movements is shown. There, also roll-levers 5 with adjustable rollers 7 are shown as pivot points for a power adjustment, working and displacement pistons being combined in one unit 73 in this Stirling engine 72 of particular simple construction. Due to this simple construction, there is a lower mechanical efficiency as compared to the β-engine, and also the power regulation will cause additional losses in efficiency. The transmission of movement in this instance is effected via the drive rods 8 with the assistance of a conventional crank 74.

Of course, the arrangement 1 can also be used to control the power of any other Stirling engine.

What is claimed is:

1. A Stirling engine (10, 50, 72) comprising at least one working piston (52) and at least one displacement piston (4) characterized in that for a power control by means of the transmission of the linear movement of a drive part (2) into the linear movement of a driven part (8), a lever (5) articulately connected to the drive part and to the driven part (2, 8) is provided, which lever has an associated displaceable pivot point (7), the bearing point of the lever (5) travelling on the pivot point (7) according to a curve during the movement transmission.

2. A Stirling engine according to claim 1, characterized in that the lever (5) has a connecting link (6) defining the given curve, which connecting link slides over the pivot point (7), via a roller defining this pivot point (7), during the movement transmission.

3. A Stirling engine according to claim 1, characterized in that the curve or connecting link (6) has the shape of a ciircular arc.

4. A Stirling engine according to claim 1, characterized in that the pivot point (7) is arranged on a pivot arm (12).

5. A Stirling engine according to claim 4, characterized in that the pivot arm (12) is connected to an adjustment device (14, 57).

6. A Stirling engine according to claim 5, characterized in that the adjustment device (14, 57) is connected via a linkage (13) each with a pivot arm (12) and is symmetrically provided between at least two levers (5).

7. A Stirling engine according to claim 6, characterized in that a spindle drive (14) is provided as the adjustment device.

8. A Stirling engine according to claim 6, characterized in that a connecting link guide (57) is provided as the adjustment device.

9. A Stirling engine according to claim 1, characterized in that the displacement piston (4) is associated with the lever (5) for a power control.

10. A Stirling engine according to claim 1, characterized in that the working piston (52) is associated with the lever (5) for a power control.

11. A Stirling engine according to claim 10, characterized in that the displacement piston (52) is associated with a lever (5') having a non-displaceable pivot point.

12. A Stirling engine according to claim 1, characterized in that the working piston (52) and the displacement piston (4) form a unit (73) which is associated with the lever (5).

13. A Stirling engine according to claim 9, characterized in that the drive part (2) is articulately connected to a piston rod (3, 3') linearly guided in a straight-line guide (30) and connected to the displacement piston (4) and to the working piston (52), respectively.

14. A Stirling engine according to claim 1, characterized in that the displacement piston (4) on both sides and the working piston (52) on one side thereof has a lamella-type wave-shaped section (23) in neighboring heater and cooler surfaces (24, 25).

15. A Stirling engine according to claim 14, characterized in that the lamella-type wave-shaped sections (23) of the displacement piston (4) are arranged turned by 90° relative to each other.

16. A Stirling engine according to claim 1, characterized in that the linear movement of the driven part (8) is converted into a rotational movement by means of a connecting link (32) which serves as crank.

* * * * *